US012805610B2

(12) United States Patent
Cao

(10) Patent No.: US 12,805,610 B2
(45) Date of Patent: Nov. 24, 2026

(54) WATCH STRAP AND WATCH

(71) Applicant: Dongguan Grands Precision Manufacture Co., Ltd., Dongguan (CN)

(72) Inventor: Yongtai Cao, Dongguan (CN)

(73) Assignee: DONGGUAN GRANDS PRECISION MANUFACTURE CO., LTD., Dongguan (CN)

( * ) Notice: Subject to any disclaimer, the term of this patent is extended or adjusted under 35 U.S.C. 154(b) by 124 days.

(21) Appl. No.: 18/970,945

(22) Filed: Dec. 6, 2024

(65) Prior Publication Data

US 2025/0185763 A1 Jun. 12, 2025

(30) Foreign Application Priority Data

Dec. 7, 2023 (CN) ..... 202311680713.2
Oct. 12, 2024 (CN) ..... 202411427377.5

(51) Int. Cl.

| | |
|---|---|
| ***A44C 5/14*** | (2006.01) |
| ***A44C 5/00*** | (2006.01) |
| ***A44C 5/10*** | (2006.01) |
| ***A44C 5/20*** | (2006.01) |
| ***A44C 5/24*** | (2006.01) |

(52) U.S. Cl.

CPC ..... *A44C 5/14* (2013.01); *A44C 5/102* (2013.01); *A44C 5/2071* (2013.01); *A44C 5/24* (2013.01); *A44C 5/0053* (2013.01)

(58) Field of Classification Search

CPC ..... A44C 5/2071; A44C 5/24; A44C 5/246; A44C 5/02; A44C 5/147; A44C 5/14; G04B 37/16

USPC ..... 24/265 WS, 71 J; D11/94; 224/164; 368/176, 282

See application file for complete search history.

(56) References Cited

U.S. PATENT DOCUMENTS 3,477,107 A * 11/1969 Nadeau ..... A44C 5/14 968/360
4,879,702 A * 11/1989 Gardner ..... G04B 37/1486 368/282

(Continued)

FOREIGN PATENT DOCUMENTS

CH 710089 A1 * 3/2016 ..... G04G 17/06
CN 215837430 U * 2/2022

(Continued)

OTHER PUBLICATIONS

Machine Translation of CH710089 (Year: 2016).*

*Primary Examiner* — Justin M Larson
(74) *Attorney, Agent, or Firm* — Leong C. Lei

(57) ABSTRACT

A watch strap and a watch are disclosed. The watch strap includes a first strap body and a second strap body each having two ends. One end of the first strap body and/or the second strap body is detachably connected to a strap connector. The other end of the first strap body is detachably connected to the other end of the second strap body through cooperation of a coupling mechanism and a button mechanism, so that the first strap body and the second strap body are selectively moved closer to each other to be locked or moved away from each other to be unlocked. In this way, the user can complete the disassembly and assembly of the watch in just one operation.

7 Claims, 30 Drawing Sheets

(56) References Cited

U.S. PATENT DOCUMENTS

| | | | | |
|---|---|---|---|---|
| 6,401,307 | B1 * | 6/2002 | Wild | A44C 5/246 24/71 J |
| 10,149,518 | B1 * | 12/2018 | de Iuliis | A44C 5/14 |
| 10,219,591 | B2 * | 3/2019 | Hatanaka | G04B 37/1486 |
| 10,327,520 | B1 * | 6/2019 | Ely | G04B 47/046 |
| 10,365,614 | B2 * | 7/2019 | Von Allmen | G04B 37/1493 |
| 10,418,693 | B2 * | 9/2019 | Xu | A44C 5/0053 |
| 11,517,082 | B2 * | 12/2022 | Schlichtig | G04B 37/22 |
| D1,039,421 | S * | 8/2024 | Chen | D11/94 |
| D1,086,930 | S * | 8/2025 | Li | D10/38 |
| D1,102,420 | S * | 11/2025 | Lee | D11/94 |
| 2007/0271740 | A1 * | 11/2007 | Yamamoto | A44C 5/246 24/265 WS |
| 2012/0240361 | A1 * | 9/2012 | Leger | A44C 5/246 24/265 EC |
| 2013/0286797 | A1 * | 10/2013 | Leger | A44C 5/18 24/316 |
| 2017/0181510 | A1 * | 6/2017 | Novak | A44C 15/0025 |
| 2018/0011448 | A1 * | 1/2018 | Von Allmen | G04B 37/1493 |
| 2018/0294554 | A1 * | 10/2018 | Xu | G04G 17/04 |
| 2019/0174882 | A1 * | 6/2019 | Cuenat | G04B 37/1486 |
| 2021/0085041 | A1 * | 3/2021 | Schlichtig | G04B 37/1486 |
| 2023/0119270 | A1 * | 4/2023 | Cazalet | A44C 5/14 368/282 |
| 2025/0172912 | A1 * | 5/2025 | Lee | A44C 5/14 |
| 2025/0185763 | A1 * | 6/2025 | Cao | A44C 5/14 |

FOREIGN PATENT DOCUMENTS

| | | | | |
|---|---|---|---|---|
| CN | 218790925 | U * | 4/2023 | |
| DE | 19729903 | A1 * | 1/1999 | A44C 5/246 |
| DE | 202024101773 | U1 * | 4/2024 | G04B 37/1486 |
| EP | 1400875 | A1 * | 3/2004 | A44C 5/147 |
| KR | 20240149712 | A * | 10/2024 | A44C 5/14 |
| KR | 20250027150 | A * | 2/2025 | A44C 5/14 |
| KR | 20250059628 | A * | 5/2025 | A44C 5/14 |
| WO | WO-9902061 | A1 * | 1/1999 | A44C 5/246 |
| WO | WO-2018044039 | A1 * | 3/2018 | H04B 1/385 |

* cited by examiner

WATCH STRAP AND WATCH

BACKGROUND OF THE INVENTION

1. Field of the Invention

The present invention relates to watch accessories, and more particularly to a watch strap and a watch.

2. Description of the Prior Art

Velcro® watch straps are developed on the market. When in use, the end of a first Velcro® strap passes through a limiting hole and is bonded to a second Velcro® strap through a hook portion. When the user intends to take off the watch from his/her hand, the end of the first Velcro® strap is pulled apart to take off the watch. However, in this way, the adhesion between the first and second Velcro® straps may attenuate due to prolonged wear and repeated removal, resulting in the watch being prone to coming loose when worn.

Therefore, there is a need to study and develop a new technical solution to solve the above problems.

SUMMARY OF THE INVENTION

In view of the deficiencies of the prior art, the primary object of the present invention is to provide a watch strap and a watch. Through the structural design and cooperation of a first strap body and a second strap body, the user can complete the disassembly and assembly of the watch in just one operation, improving the ease with which the user can put on or take off the watch when in use. The watch is very easy to put on or take off. It takes less time to put on or take off the watch each time. The watch is highly stable when worn.

In order to achieve the above object, the present invention adopts the following technical solutions:

A watch strap comprises a first strap body and a second strap body. The first strap body and the second strap body each have two ends. One end of the first strap body and/or the second strap body is detachably connected to a first end of a strap connector. A second end of the strap connector is connected to a watch dial.

The other end of the first strap body is connected to a coupling mechanism. The coupling mechanism includes a coupling member and a spring bar assembly. The coupling member has two ends. One end of the coupling member is connected to the other end of the first strap body. Two sides of the coupling member have mounting recesses. The spring bar assembly is retractably disposed in the mounting recesses. The spring bar assembly includes a knob, a sleeve, and a first resilient device between the knob and the sleeve for moving the knob backward or forward.

The other end of the second strap body is connected to a button mechanism configured for controlling extension and retraction of the spring bar assembly. The button mechanism includes a connecting member and a locking button. The connecting member has two ends. One end of the connecting member is connected to the other end of the second strap body. The connecting member has a first placement position for mounting the coupling mechanism and a second placement position for mounting the locking button. The first placement position communicates with the second placement position.

The locking button includes a pressing member, a sleeving member fitted on the pressing member, and a second resilient device between the pressing member and the sleeving member for moving the pressing member backward or forward. The locking button is disposed in the second placement position. The pressing member has a button end extending out of the connecting member.

The other end of the first strap body is detachably connected to the other end of the second strap body through cooperation of the coupling mechanism and the connecting member, so that the locking button and the spring bar assembly are selectively moved closer to each other to be locked or moved away from each other to be unlocked.

A watch comprises a watch dial and a watch strap. The watch strap is detachably connected to the watch dial. The watch strap is the foregoing watch strap. An exterior of one end of the watch dial is recessed inwardly to form a mounting groove. A docking groove is disposed beside the mounting groove. A docking portion of the strap connector is connected to the docking groove. An end face of one side of the mounting groove has a first locking portion extending toward the mounting groove. The strap connector partially extends in the mounting groove. The docking portion is engaged with the docking groove. The first locking portion and the second locking portion are locked to each other.

Compared with the prior art, the present invention has obvious advantages and beneficial effects. Specifically, it can be known from the above technical solutions. Through the structural design and cooperation of the first strap body and the second strap body, the other end of the first strap body is detachably connected to the other end of the second strap body through cooperation of the coupling mechanism and the connecting member, so that the locking button and the spring bar assembly are selectively moved closer to each other to be locked or moved away from each other to be unlocked. When the user wants to wear the watch, the first strap body and the second strap body are moved away from each other. When the user's wrist is placed into the space enclosed by the first strap body and the second strap body, the second strap body is locked to one end of the first strap body. Through cooperation of the coupling mechanism and the connecting member, the first strap body and the second strap body are moved closer to each other to be locked. At this time, one end of the knob of the spring bar assembly is located in the second placement position and is in contact with one end of the pressing member. The knob provides a stable holding force under the action of the first resilient device, so that one end of the knob is secured in the second placement position to prevent it from coming loose.

When the user wants to take off the watch, he/she just presses the locking button on the second strap body. The pressing member of the locking button is pushed toward the knob on the first strap body under the force of the second resilient device, and one end of the knob is pushed out from the second placement position and pressed back into the sleeve, such that the first strap body and the second strap body can be separated and unlocked with ease, and the user can take off the watch. The user can complete the disassembly and assembly of the watch in just one operation, improving the ease with which the user can put on or take off the watch when in use. The watch is very easy to put on or take off. It takes less time to put on or take off the watch each time. The watch is highly stable when worn.

For further explaining the objectives, technical schemes, and benefits of the present invention achieves the certain objectives, the following description, in conjunction with the accompanying drawings and preferred embodiments, is set forth as below.

DETAILED DESCRIPTION OF THE PREFERRED EMBODIMENTS

Figure 1:
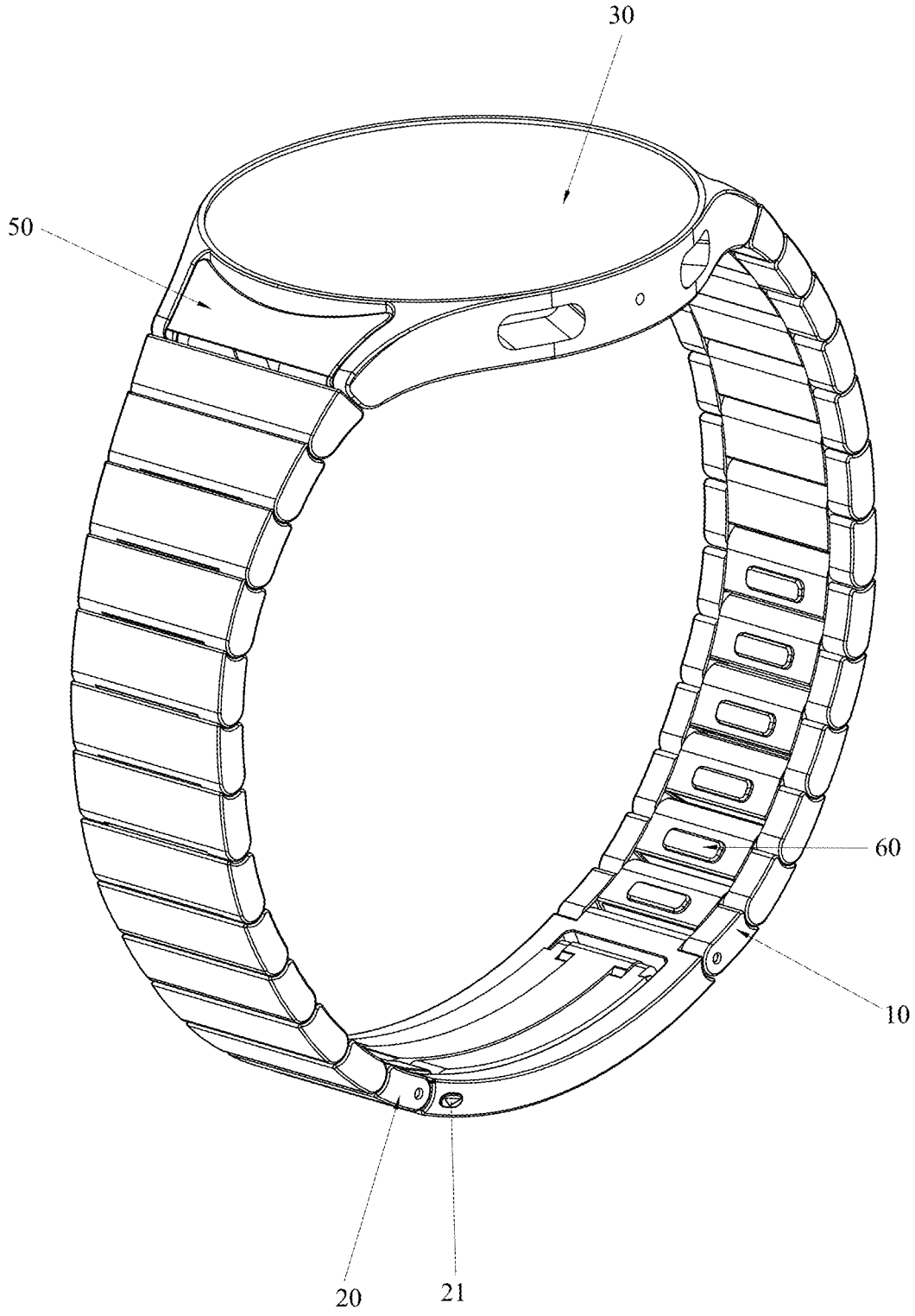
FIG. 1 is a schematic view according to a first embodiment of the present invention (in a fastened state)
Figure 2:
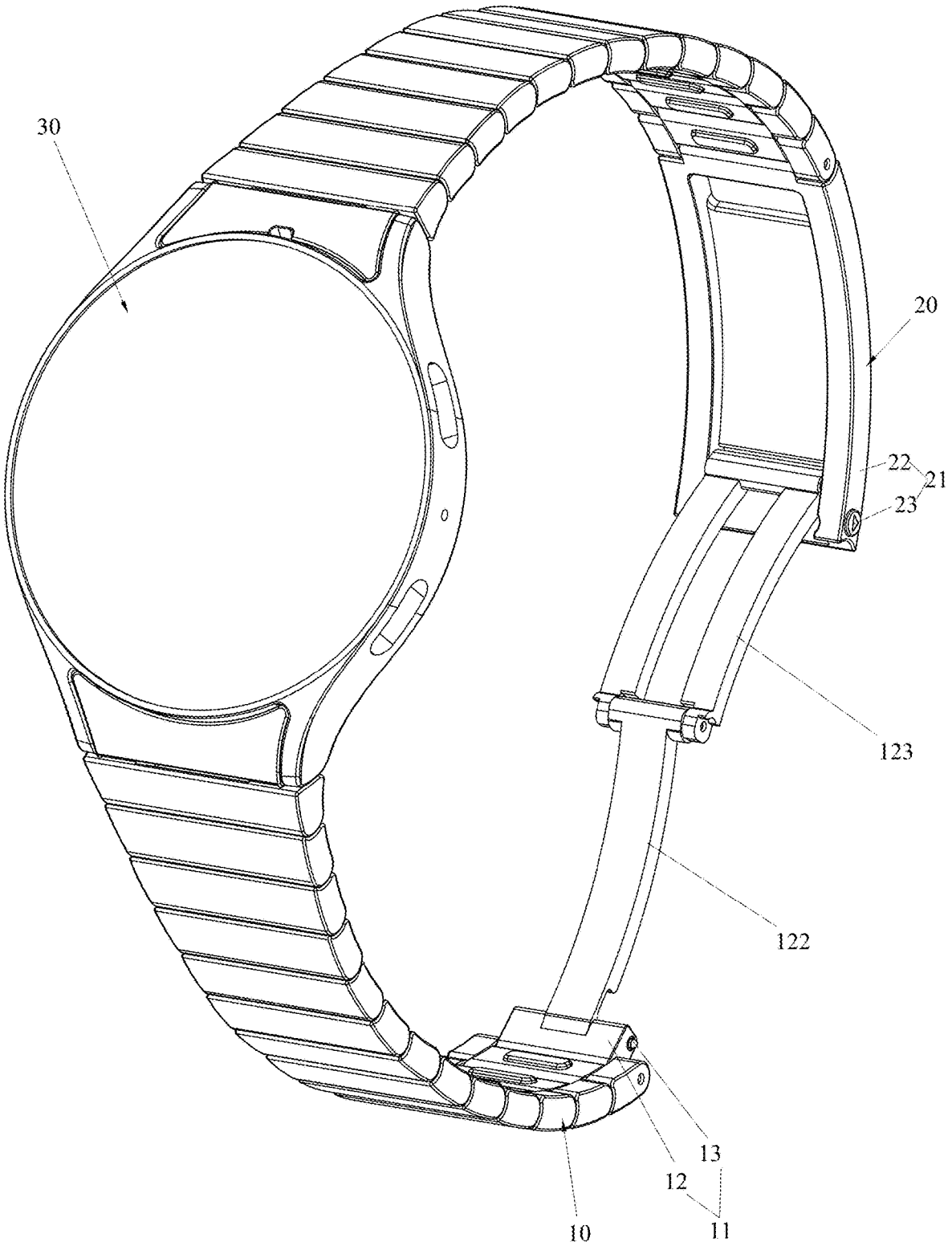
FIG. 2 is a schematic view according to the first embodiment of the present invention (in an unfastened state)
Figure 3:
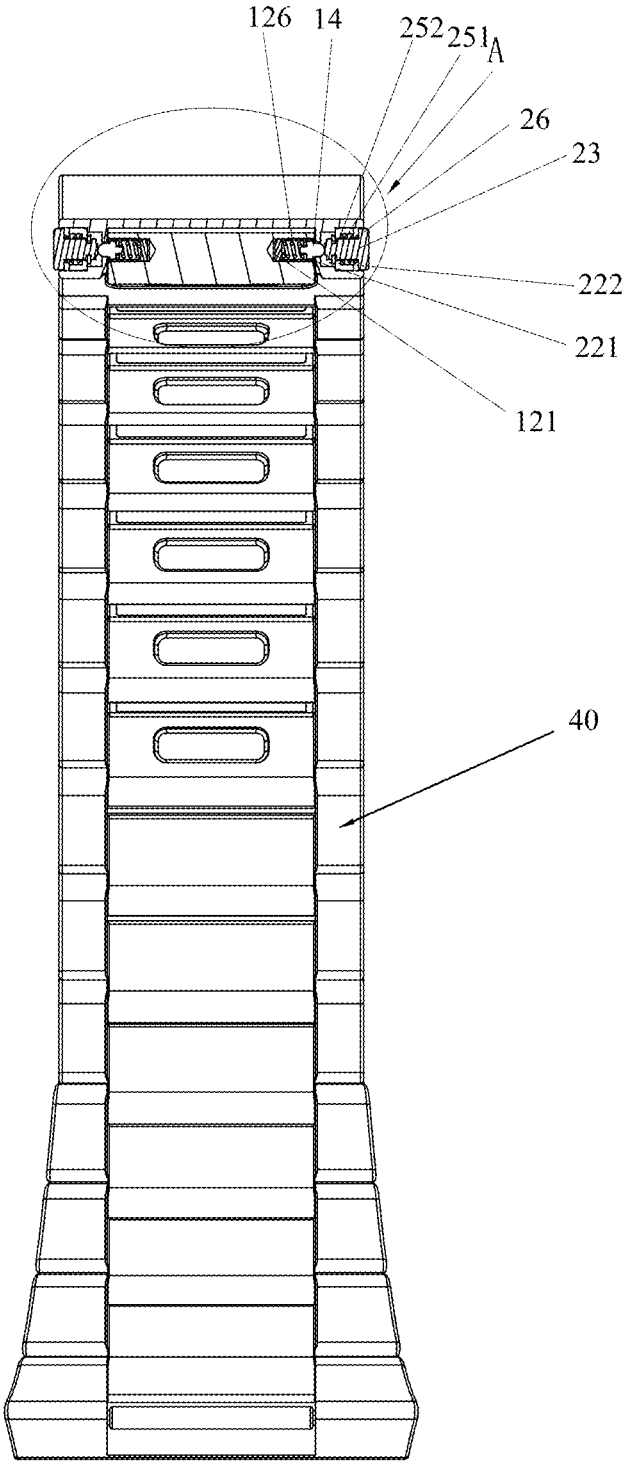
FIG. 3 is a cross-sectional view according to the first embodiment of the present invention.

FIGS. 1 to 30 illustrate specific structures of various embodiments of the present invention.

A watch strap comprises a first strap body 10 and a second strap body 20.

One end of the first strap body 10 and/or the second strap body 20 is detachably connected to a first end of a strap connector 50. A second end of the strap connector 50 is connected to a watch dial 30.

Preferably, the first strap body 10 and the second strap body 20 each include a plurality of strap links 60. Adjacent ones of the strap links 60 are detachably connected to each other. The first end of the strap connector 50 is detachably connected to one end of the strap links 60.

The plurality of strap links 60 include at least two link bodies that are assembled together. The exteriors of the link bodies have a first mating portion and a second mating portion. The link bodies are connected in pairs through the first mating portion of one link body to be mated with the second mating portion of the adjacent link body. A second docking assembly 63 is provided on the first mating portion.

The second docking assembly of either end of the plurality of strap links 60 is detachably connected to a mating groove of the watch trap connector. In this way, a corresponding strap connector is selected according to actual needs, so that it can be adapted to a variety of watch dials.

FIGS. 18 to 23 illustrate the mating structures of various watch dials, watch straps and strap connectors. The watch straps and the strap connector may be leather straps, stainless steel straps, sports straps and the like. In actual application, the strap connector is connected to one end of the leather strap or stainless steel strap or sports strap. According to actual needs, a corresponding strap and a corresponding strap connector can be selected. The watch dial may be a variety of watch dials with multiple specifications. At least one end of the watch dial is detachably connected to the second end of the strap connector. According to actual needs, a corresponding watch dial is selected.

The strap link 60 includes a base 62, a second docking assembly 63 on the base 62, and a second control button 64 for controlling movement of the second docking assembly 63.

The second docking assembly 63 includes a second engaging member 65, a second slide block 66, and a fitting member 67 connected between the second engaging member 65 and the second slide block 66. The second engaging member slides along with the second slide block.

The second control button 64 extends out of the base 62 and can be pressed backward and automatically returns forward when not pressed.

As shown in FIGS. 10 to 13, the strap link 60 further includes a second housing 61. The second housing 61 has a first mounting position 611 for mounting the base 62, a second mounting position 612 for mounting the second docking assembly 63, and a second mounting position 612 for mounting the second control button 64. The first mounting position 611 is spaced apart from the second mounting position 612. The third mounting position 613 faces and is connected to the first mounting position 611.

The base 62 has a positioning chamber 621, a positioning post 622, and a positioning portion 623. The positioning post 622 and the positioning portion 623 are located beside the positioning chamber 621. The positioning portion 623 has a curved recess 624.

This embodiment includes two second docking assemblies 63. A third elastic member 68 and a fourth elastic member 69 are connected between the two second docking assemblies 63. The two second docking assemblies 63 each include the second engaging member 65, the second slide block 66, and the fitting member 67 connected between the second engaging member 65 and the second slide block 66. The second engaging member 65 slides along with the second slide block 66. A third connecting portion protrudes from the inner side of the fitting member 67. The third elastic member 68 is disposed on the third connecting portion for pushing the second engaging member 65 to slide along the positioning chamber 621. When the second engaging member 65 is mounted in the second mounting position 612, the other end of the second engaging member 65 can be extended out of the second housing 61 or retracted into the second housing 61.

The second engaging member 65 is integrally formed on the outside of the fitting member 67. The second engaging member 65 is integrally formed with the fitting member 67, so that they can be molded in one piece directly through the mold. Compared with the assembled structure, it is simpler and easier to mold the second engaging member 65 integrally formed with the fitting member 67, and the second engaging member 65 has higher structural strength.

The second slide block 66 has an inclined arc portion 661 and a fourth connecting portion. The fourth connecting portion protrudes from the inner side of the second slide block 66. The fourth elastic member 69 is disposed on the fourth connecting portion for pushing the second slide block 66 to slide along the positioning chamber 621. Either end of the fourth elastic member 69 is connected to the fourth connecting portion.

One end of the second docking assembly 63 is located on the base 62. The second slide block 66 is against the positioning chamber 621. The fitting member 67 is against the positioning portion 623. One end of the second engaging member 65 is located in the curved recess 624. The base 62 and the second docking assembly 63 are mounted in the first mounting position 611 and the second mounting position 612, respectively.

The second control button 64 has a button body 641 and two curved blocks 642 on the left and right sides of the bottom of the button body 641. The button body 641 has a positioning hole 643 for insertion of the positioning post 622. The second control button 64 extends out of the third mounting position 613 and can be pressed backward and automatically returns forward when not pressed. The button body 641 and the two curved blocks 642 are located in the third mounting position 613. When the second control button 64 is pressed backward, the curved block 642 slides on the inclined arc portion 661 so that the second slide block 66 moves inwardly and enables the second engaging member 65 to retract in the second housing 61. By the curved block 642 of the second control button 64 being pressed against the inclined arc portion 661, the contact area between the curved block 642 of the second control button 64 and the inclined surface of the second slide block 66 is reduced, thereby reducing the friction between the second control button 64 and the second slide block 66, and subsequently reducing the pressing force required. The operation is more effortless. Besides, the installation or removal of the strap links 60 is simple, easy and quick and does not require the use of external tools, which saves time and effort, realizes easy and quick dismantling and replacement. It is easy to adjust the length of the watch strap. Through the third elastic member 68 and the fourth elastic member 69, the second slide block 66 and the fitting member 67 is provided with sufficient return force or holding force to improve the connection between the adjacent strap links 60, so as to prevent them from coming loose.

When it is necessary to adjust the length of the watch strap, the second control button 64 is pressed down, and the curved block 642 slides obliquely downward on the inclined arc portion 661 to move the positioning hole 643 up and down along the positioning post 622, such that the second slide block 66 moves inwardly and enables the second engaging member 65 to retract in the second housing 61. At this time, both the third elastic member 68 and the fourth elastic member 69 are in a compressed state.

When the second control button 64 is released, under the return force of the third elastic member 68 and the fourth elastic member 69, the second slide block 66 moves outward and drives the second engaging member 65 to move outward. At the same time, the curved block 642 moves obliquely upward along with the movement of the inclined arc portion 661, and then the second control button 64 is returned.

The first end of the strap connector 50 has a mating groove 58 corresponding to the second engaging member 65. The second docking assembly extends in the mating groove 58 so that the second engaging member is engaged in the mating groove.

The second end of the strap connector 50 has an extension portion 59 and a docking portion 591 corresponding to a docking groove of a watch dial. The docking portion 591 is located beside the extension portion 59. A second locking portion 592 protrudes from the extension portion 59 and corresponds to a first locking portion of the watch dial.

Through the strap connector, when the watch strap is assembled, the first locking portion and the second locking portion are locked to each other. When the watch strap is disassembled, the first locking portion and the second locking portion are moved away from each other. The overall structure design is ingenious and reasonable, which makes the assembly of the watch dial and the watch strap easy and compact. This ensures the stability and reliability of the subsequent finished watches in use.

Figure 9:
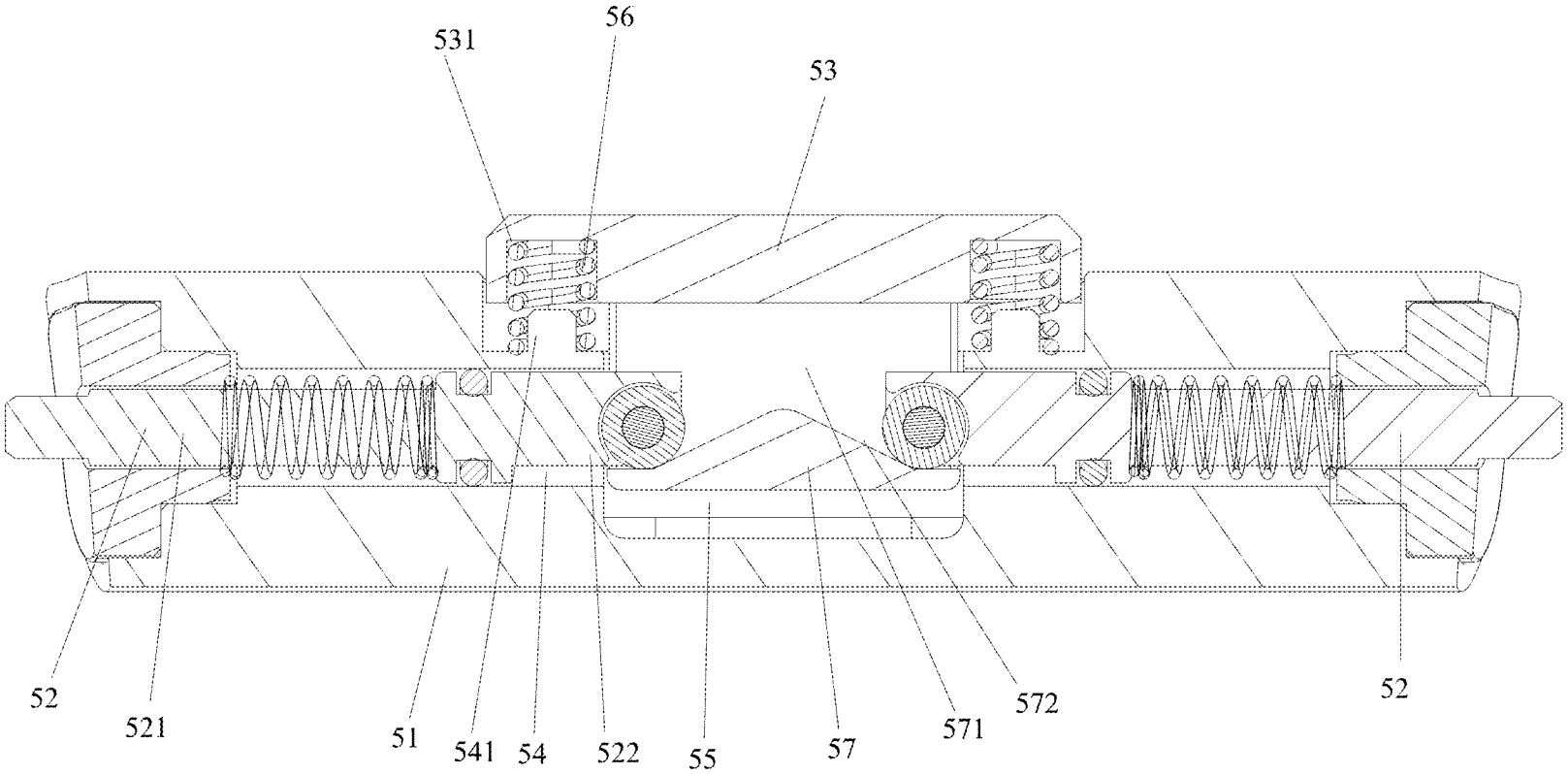
FIG. 9 is a cross-sectional view of the strap connector according to an embodiment of the present invention.
Figure 10:
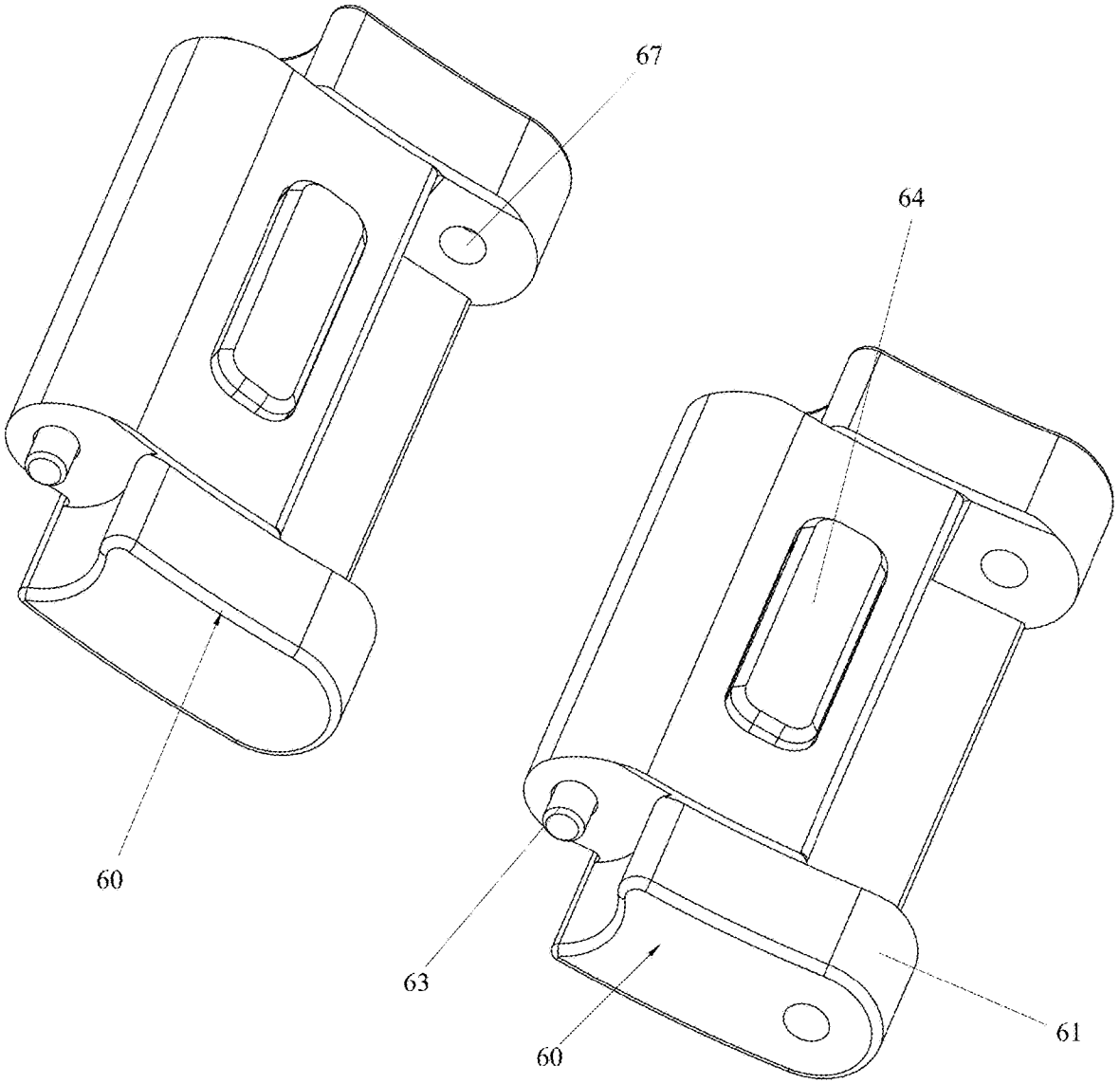
FIG. 10 is a schematic view of the strap links according to an embodiment of the present invention.
Figure 11:
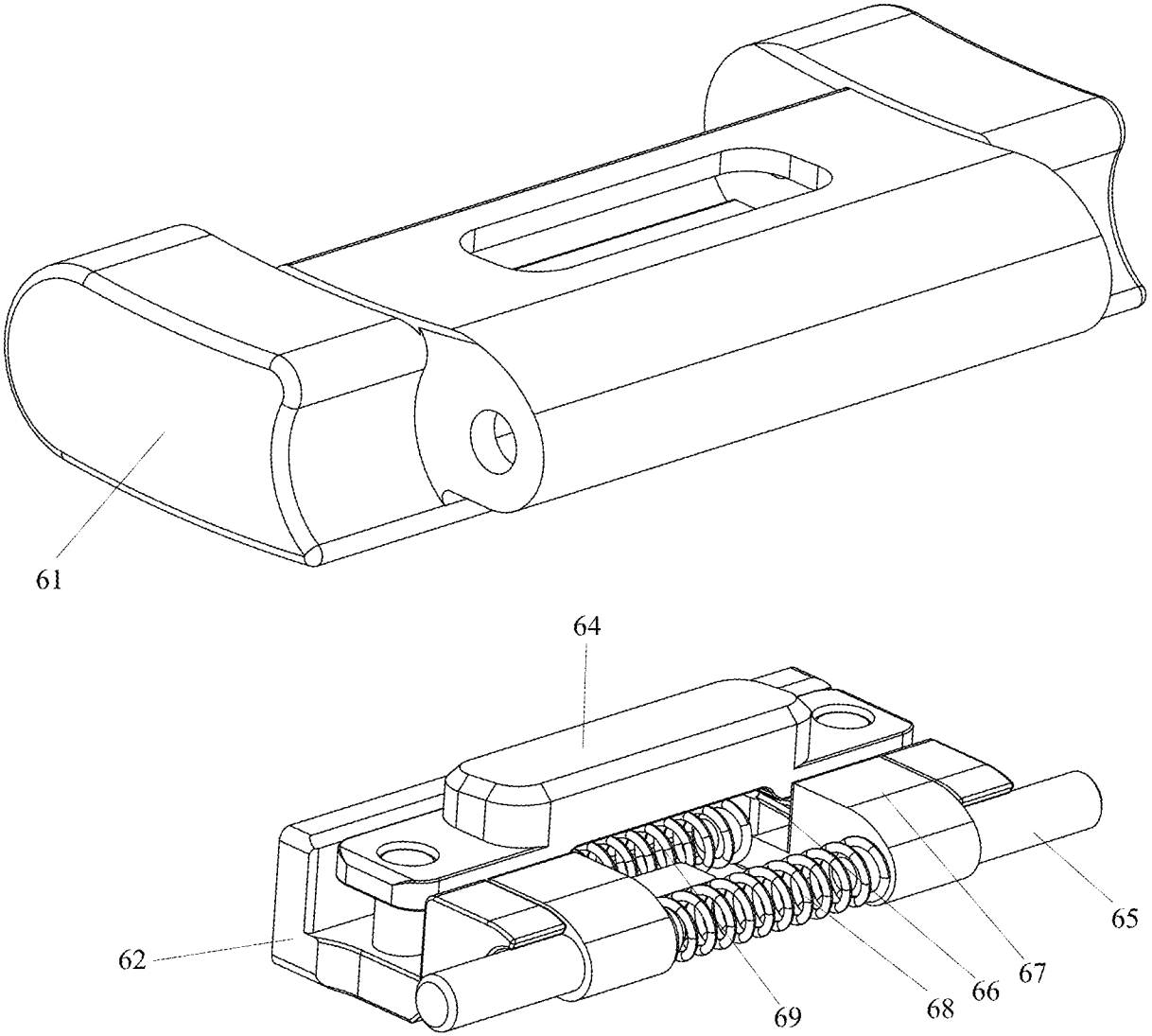
FIG. 11 is an exploded view of the strap link according to an embodiment of the present invention.
Figure 12:
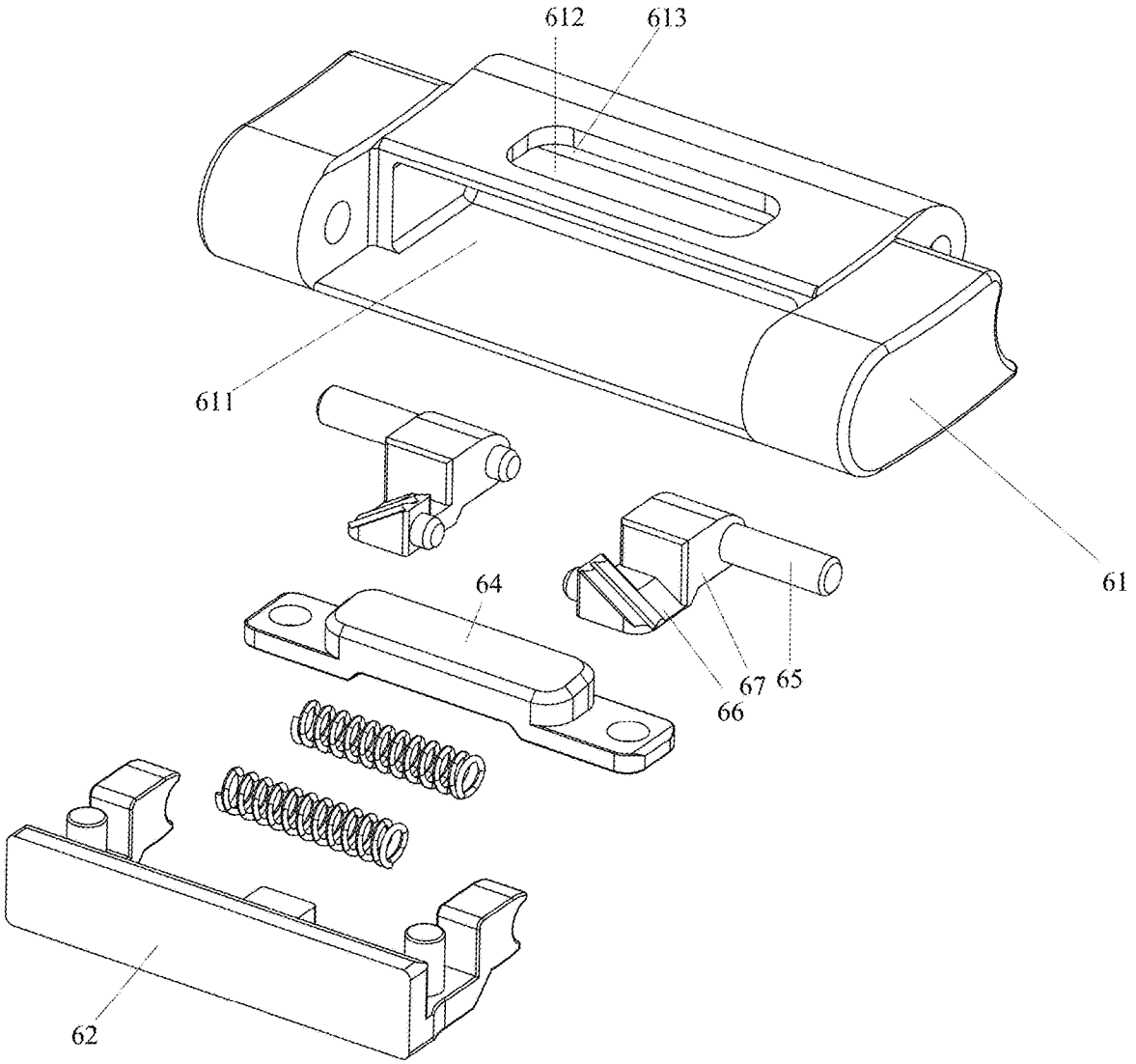
FIG. 12 is another exploded view of the strap link according to an embodiment of the present invention.
Figure 13:
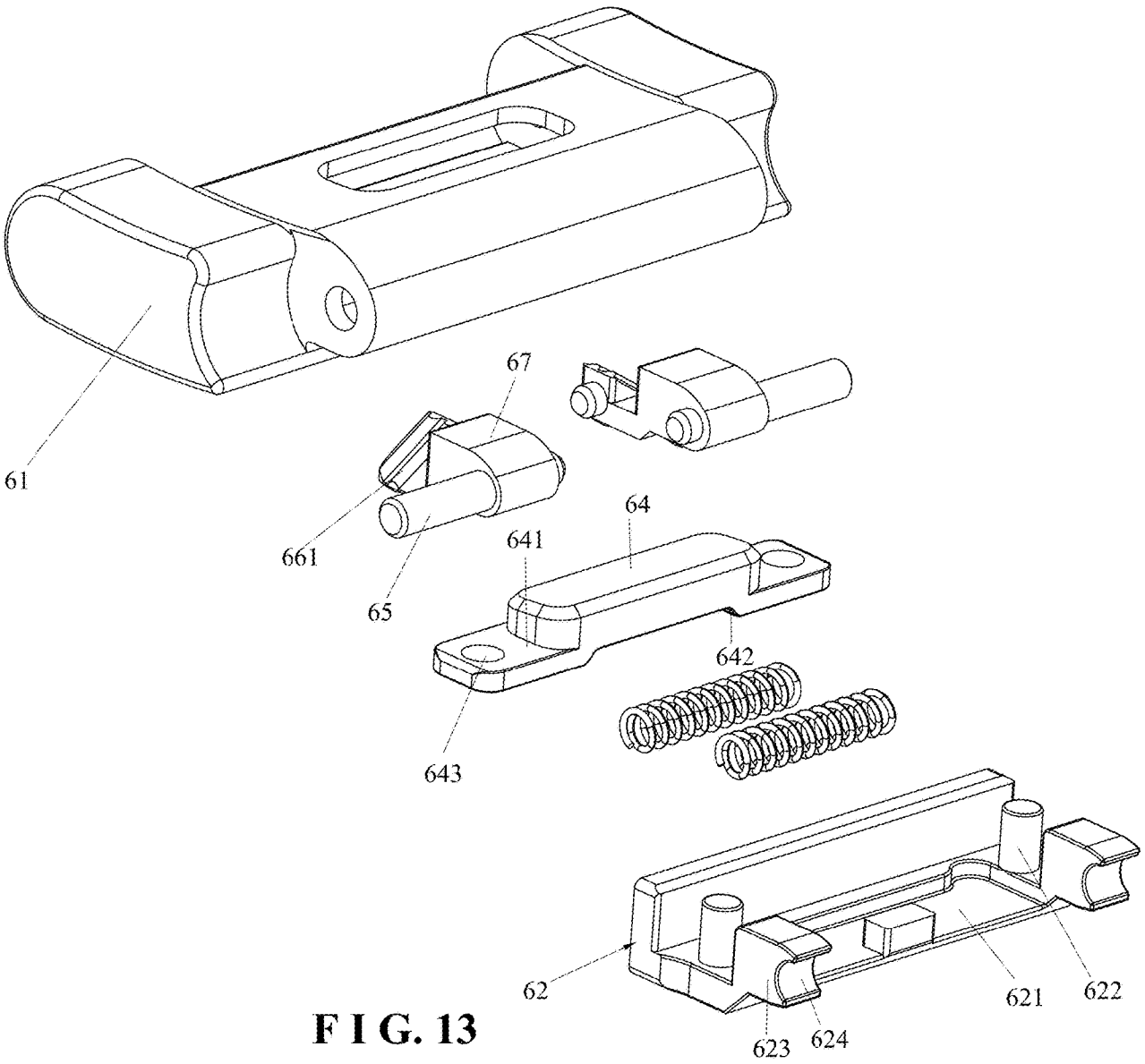
FIG. 13 is a further exploded view of the strap link according to an embodiment of the present invention.
Figure 14:
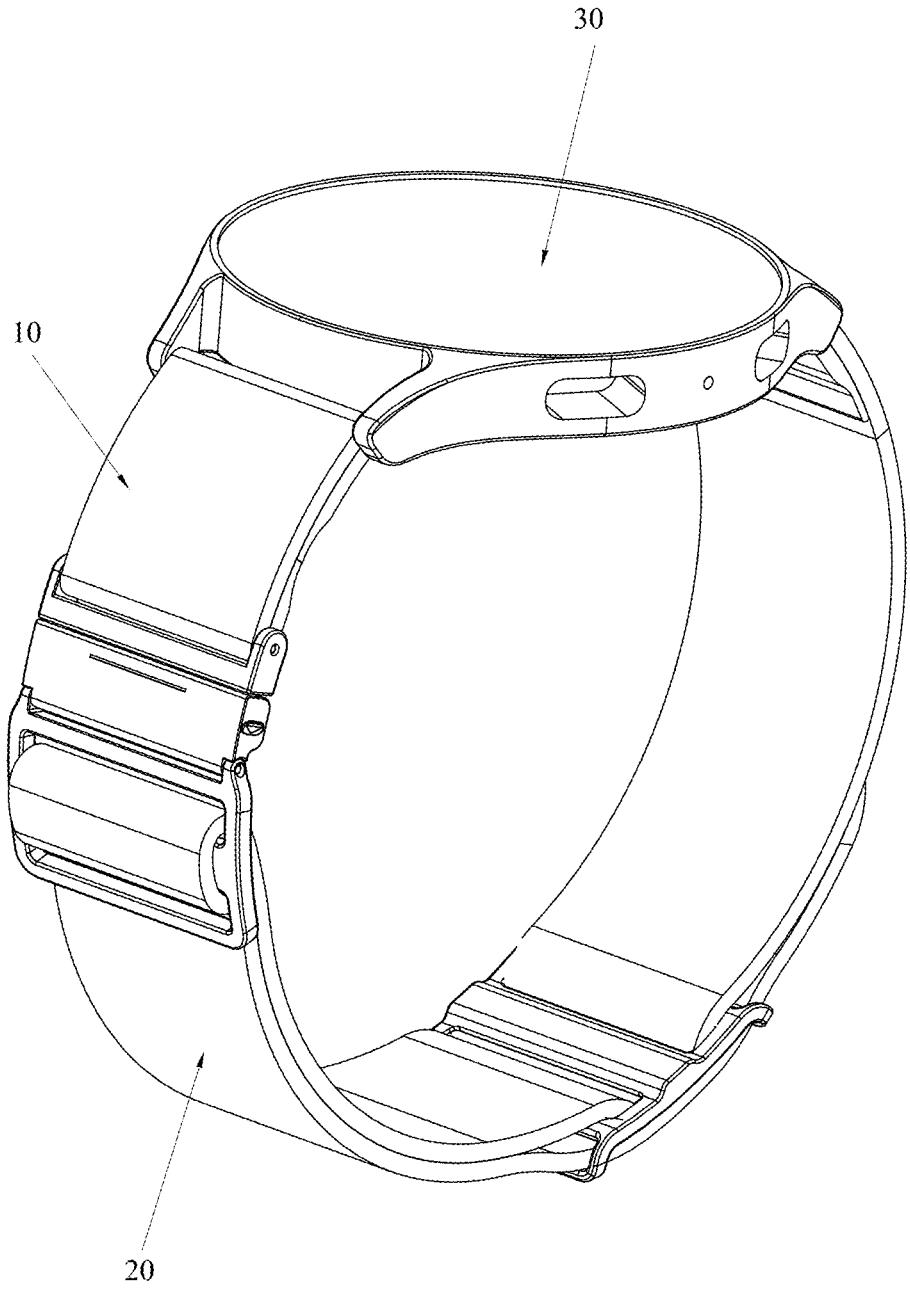
FIG. 14 is a schematic view according to a second embodiment of the present invention (in a fastened state)
Figure 15:
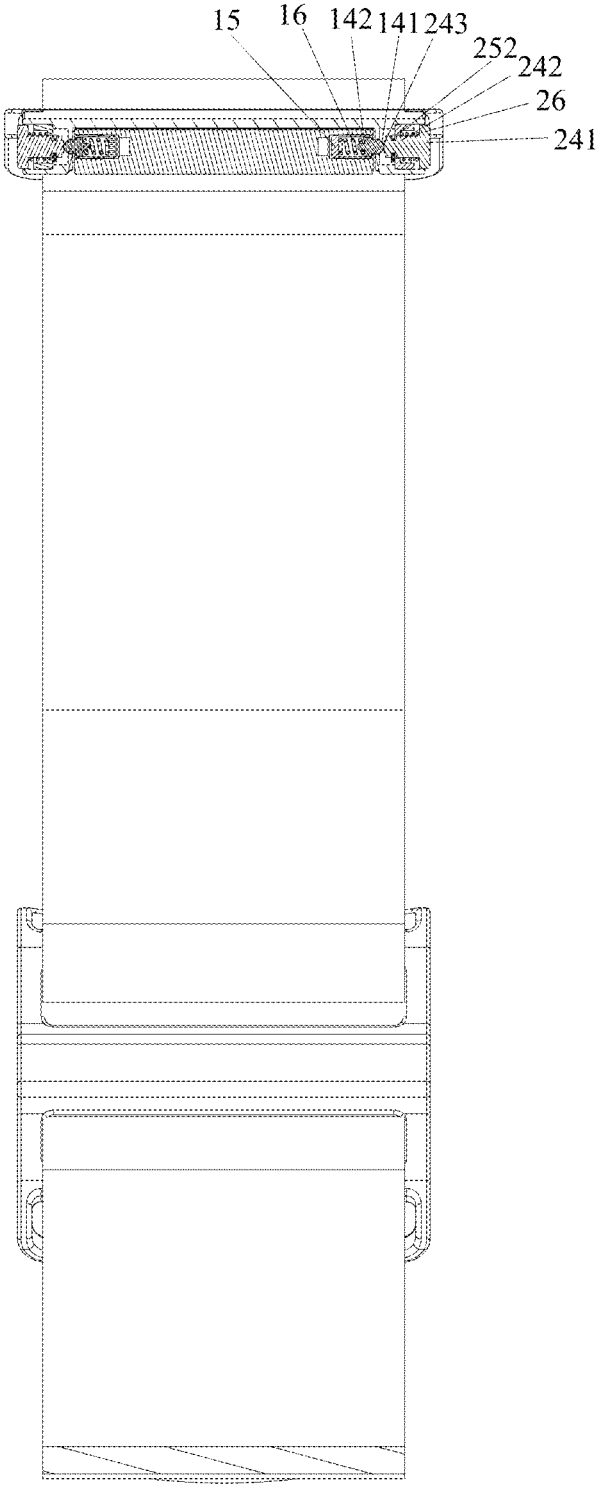
FIG. 15 is a cross-sectional view according to the second embodiment of the present invention.
Figure 16:
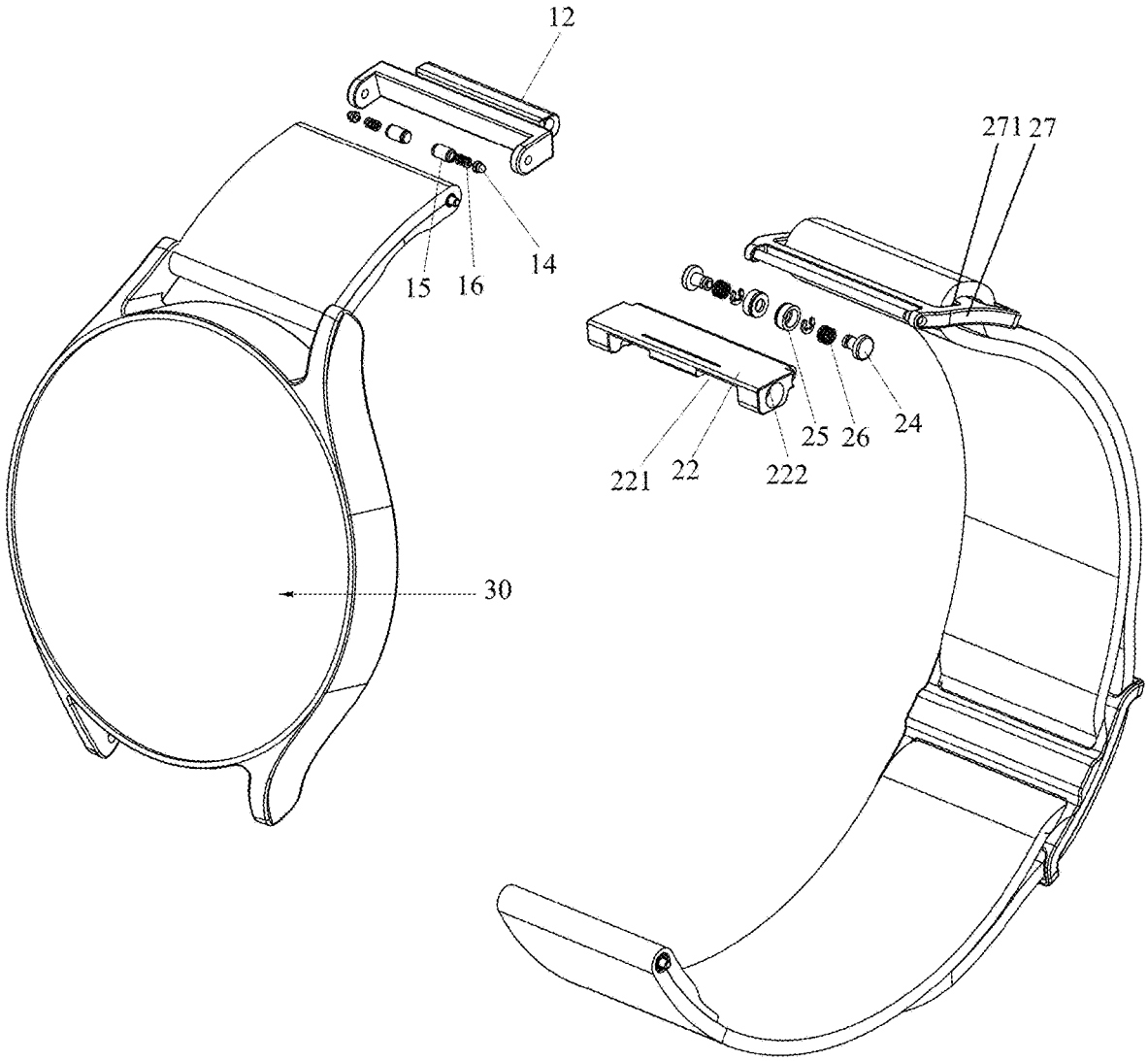
FIG. 16 is an exploded view according to the second embodiment of the present invention.
Figure 17:
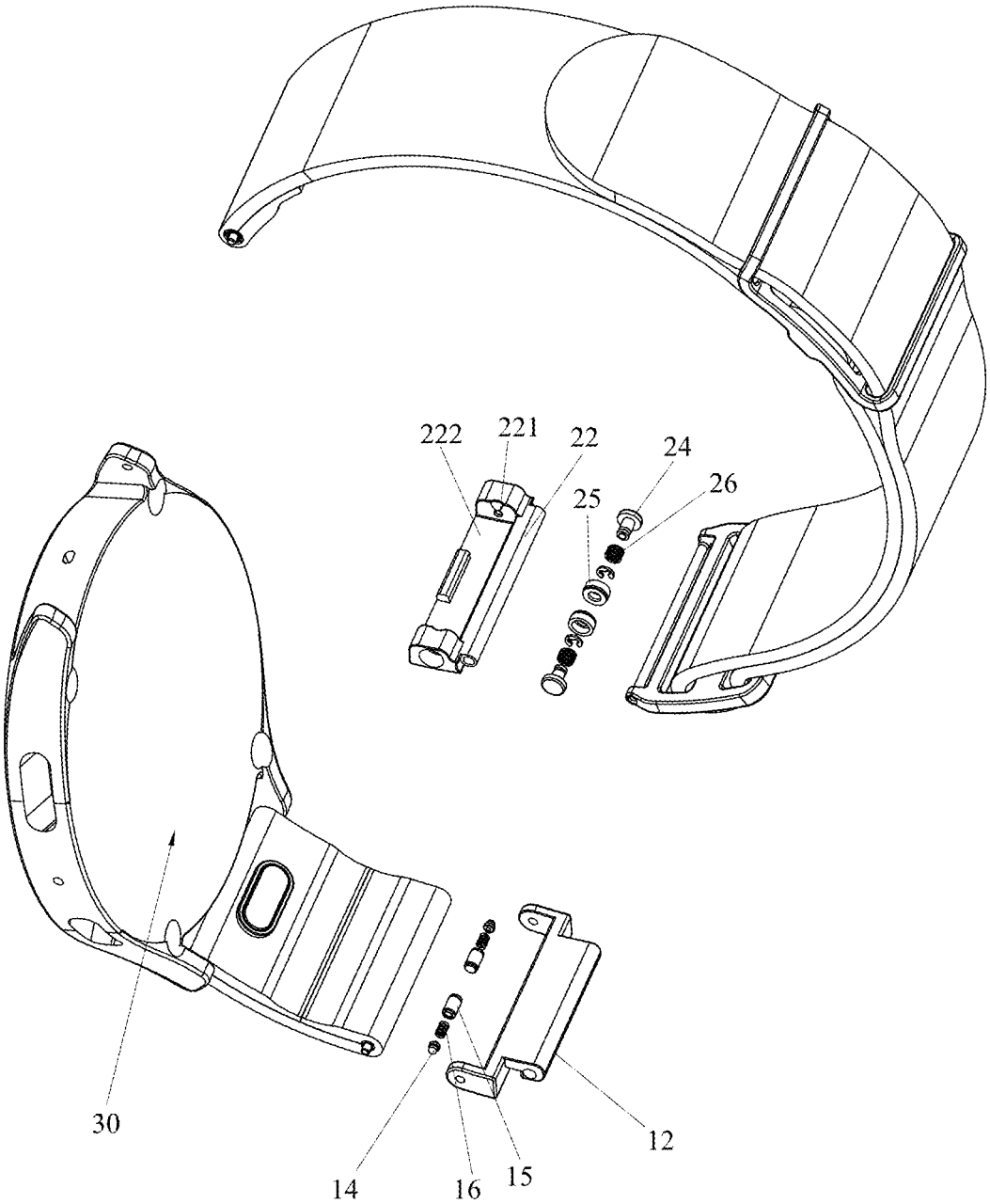
FIG. 17 is another exploded view according to the second embodiment of the present invention.
Figure 18:
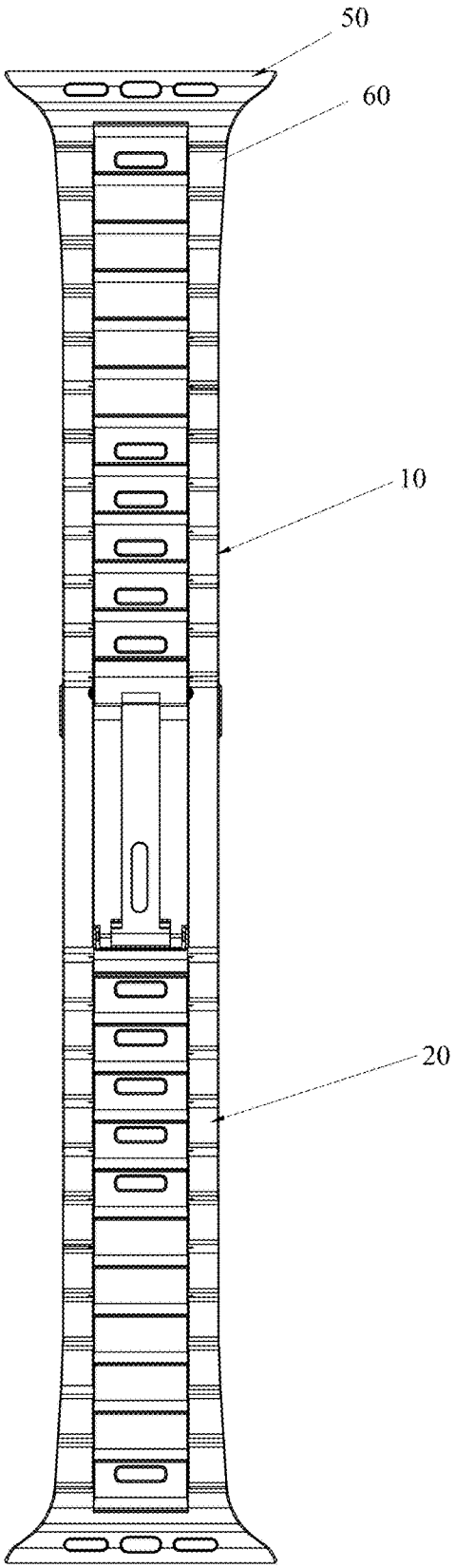
FIG. 18 is a schematic view of the watch strap according to a third embodiment of the present invention.
Figure 19:
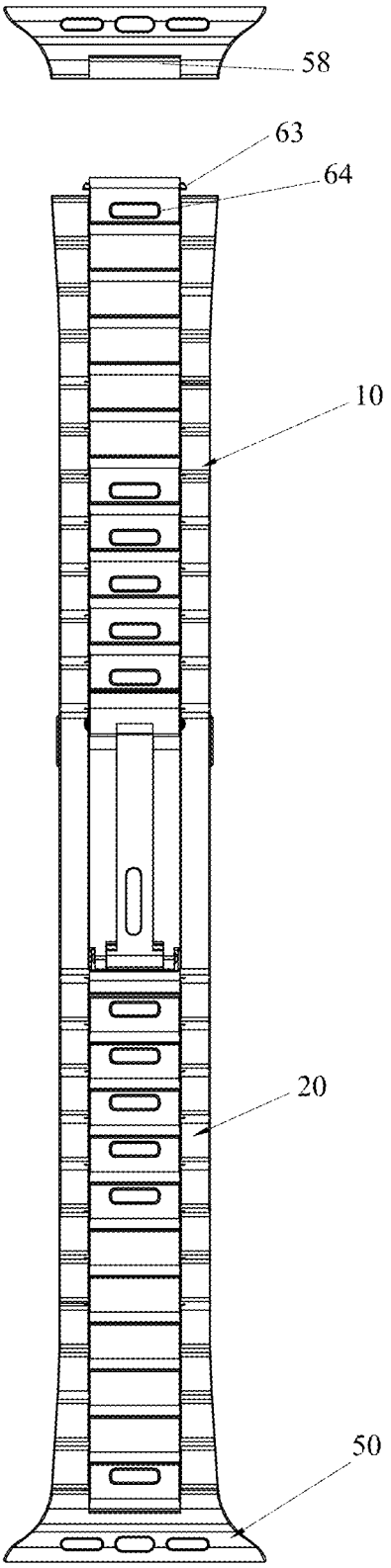
FIG. 19 is an exploded view of the watch strap according to the third embodiment of the present invention.
Figure 20:
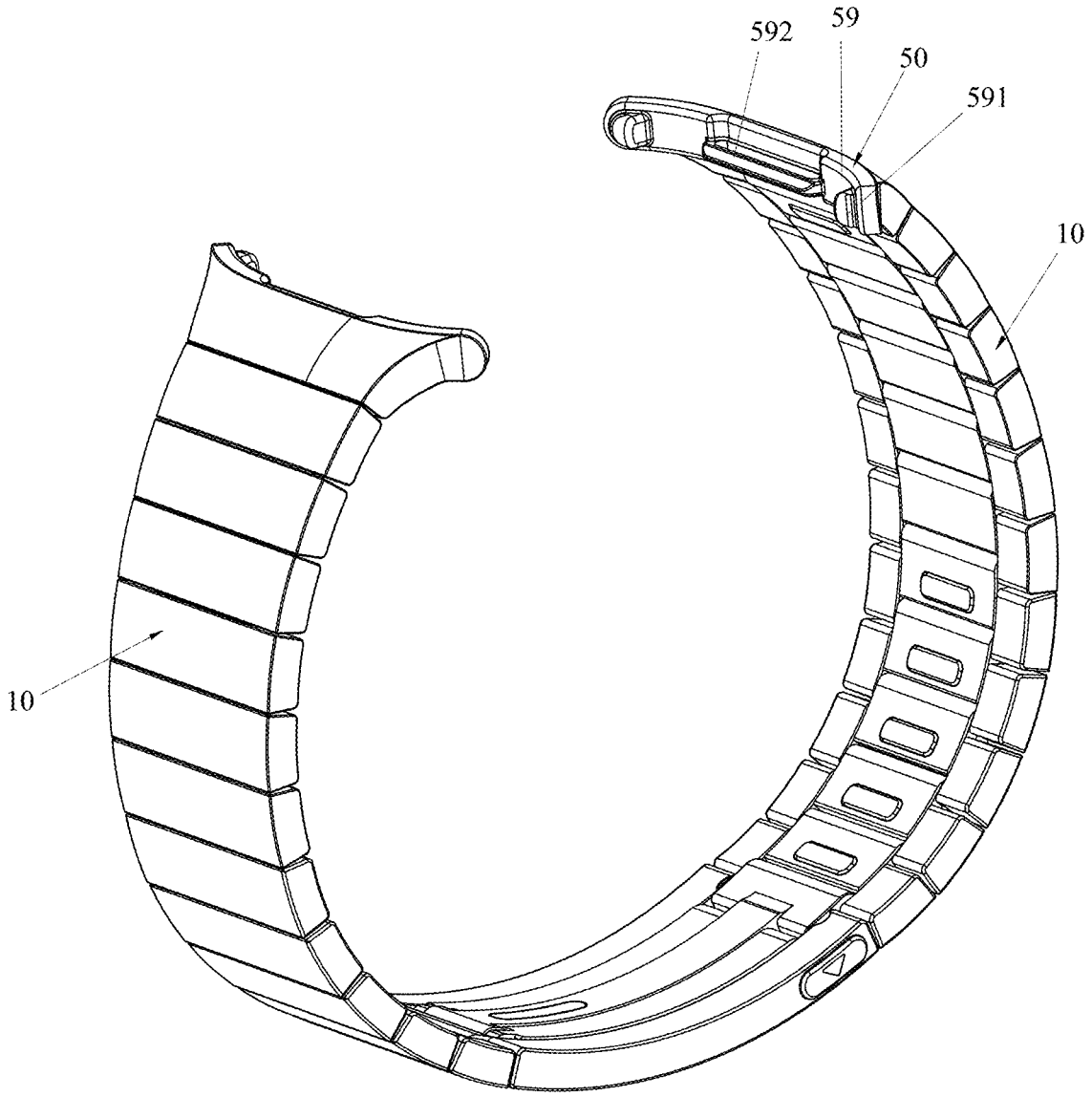
FIG. 20 is a schematic view of the watch strap according to a fourth embodiment of the present invention.
Figure 21:
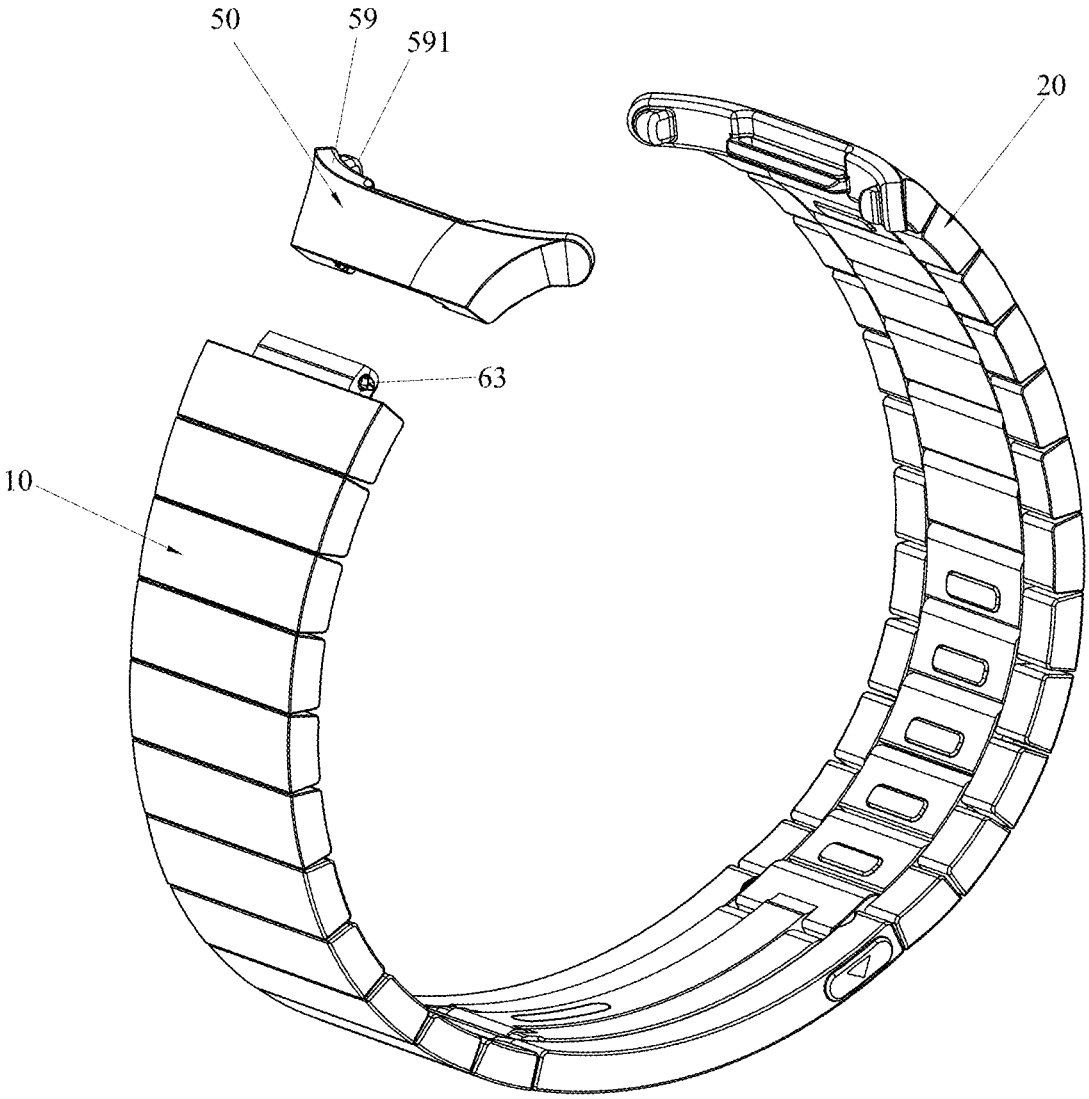
FIG. 21 is an exploded view of the watch strap according to the fourth embodiment of the present invention.
Figure 22:
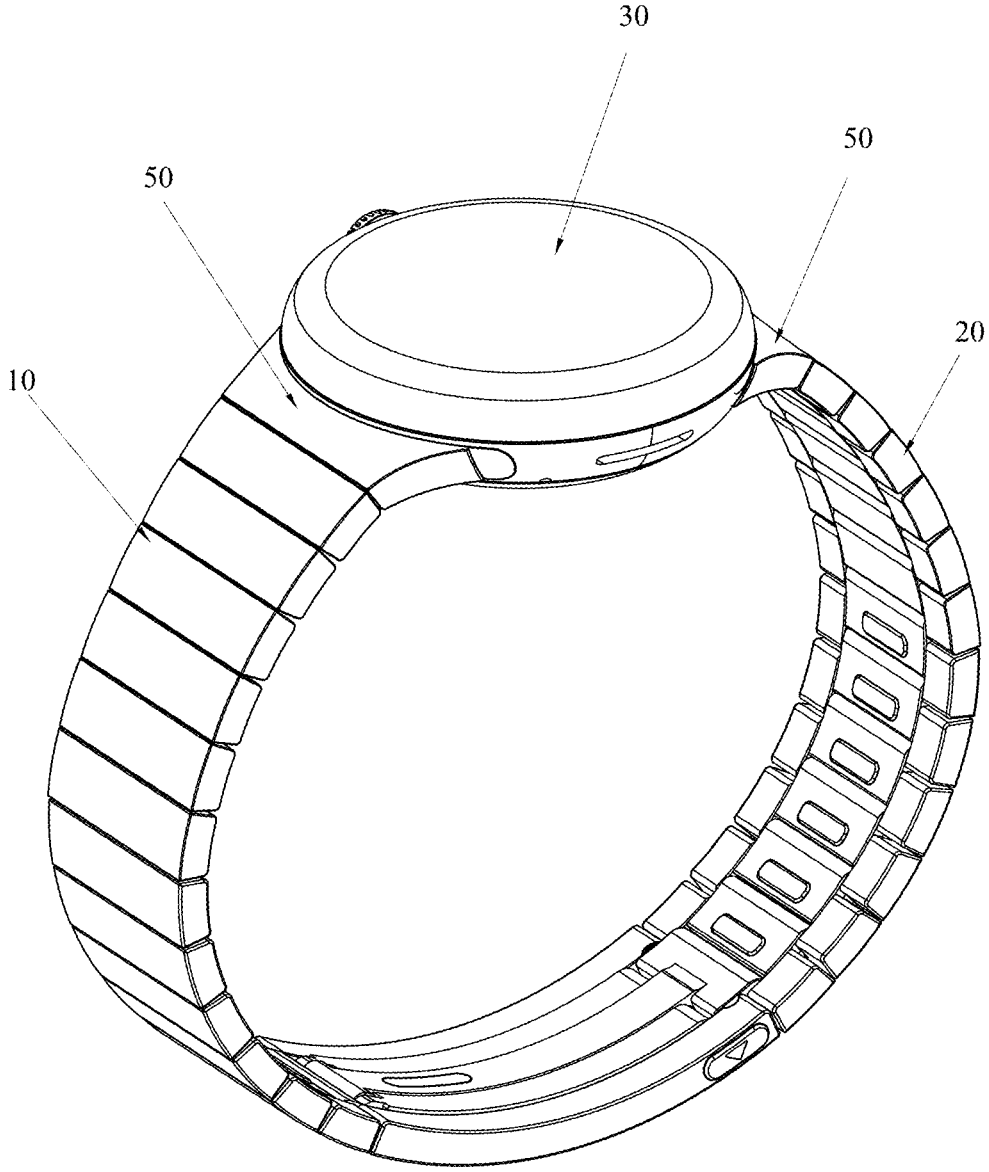
FIG. 22 is a schematic view of the watch strap according to a fifth embodiment of the present invention.
Figure 23:
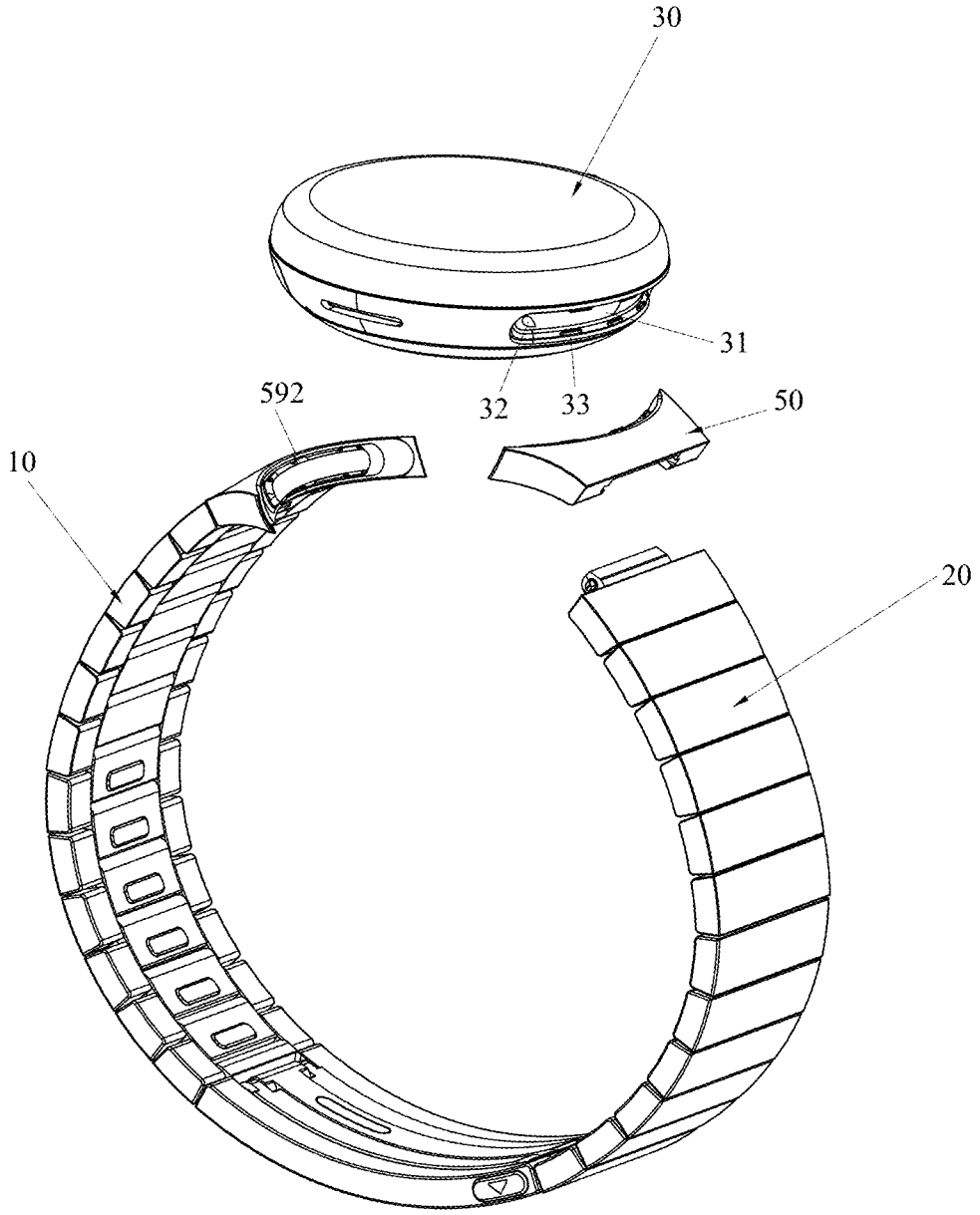
FIG. 23 is an exploded view of the watch strap according to the fifth embodiment of the present invention.
Figure 24:
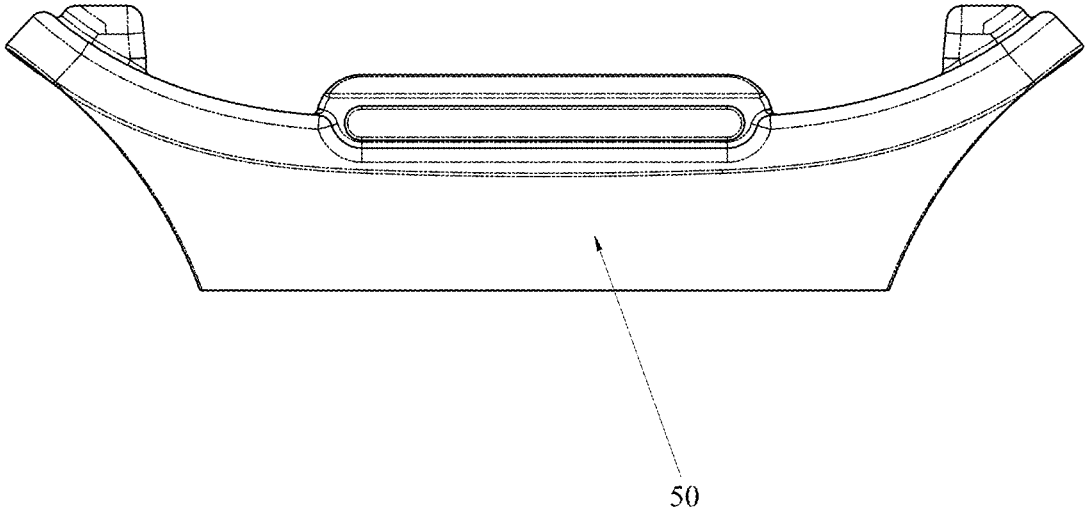
FIG. 24 is a schematic view of a first example of the strap connector according to an embodiment of the present invention.
Figure 25:
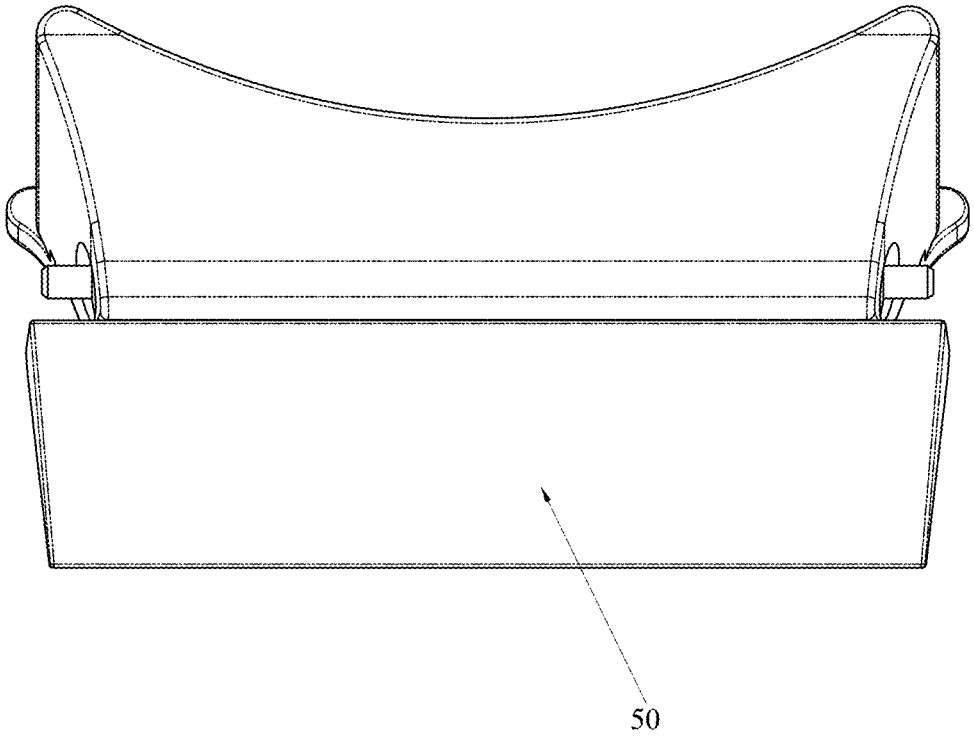
FIG. 25 is a schematic view of a second example of the strap connector according to an embodiment of the present invention.
Figure 26:
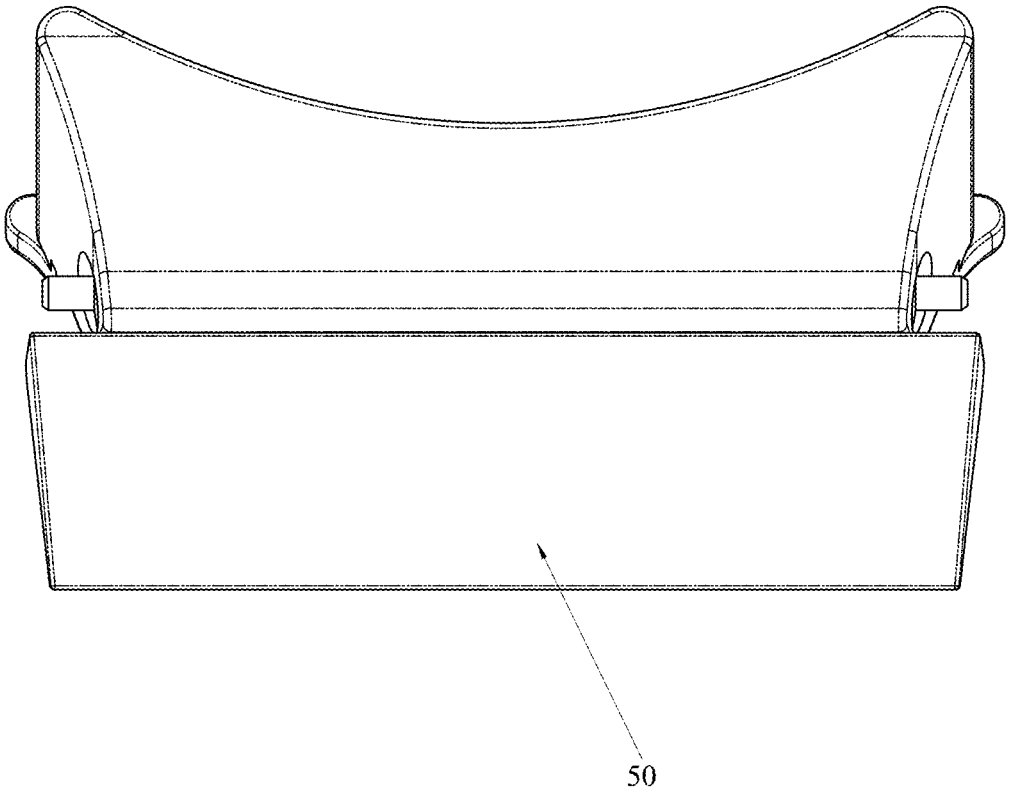
FIG. 26 is a schematic view of a third example of the strap connector according to an embodiment of the present invention.
Figure 27:
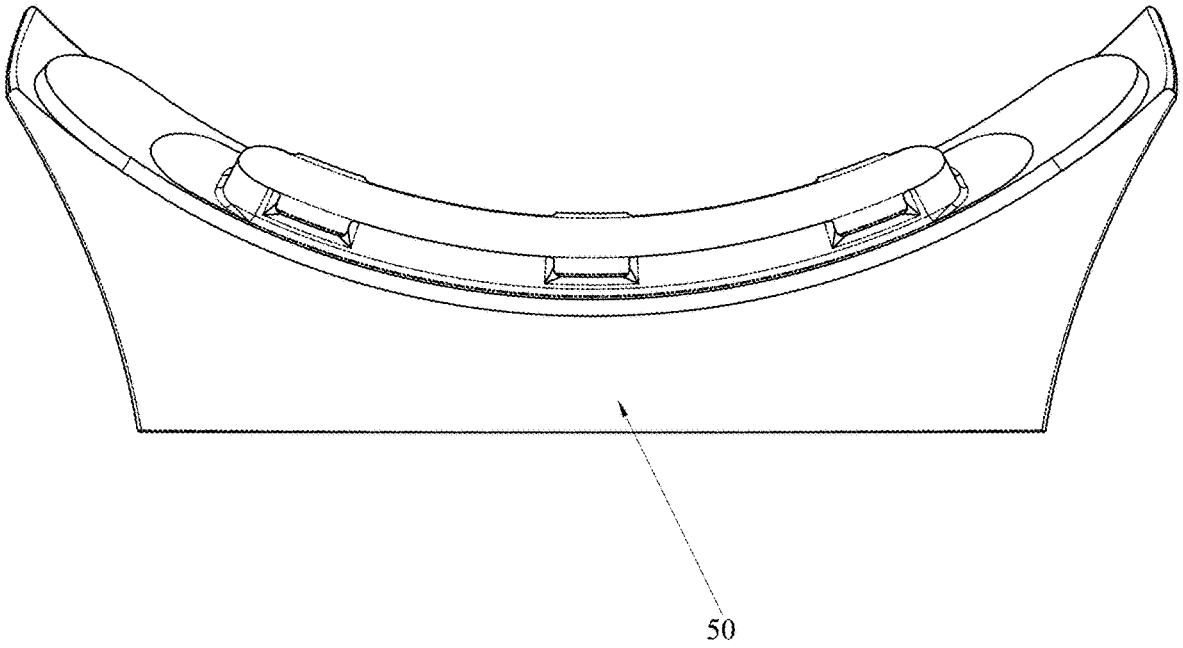
FIG. 27 is a schematic view of a fourth example of the strap connector according to an embodiment of the present invention.
Figure 28:
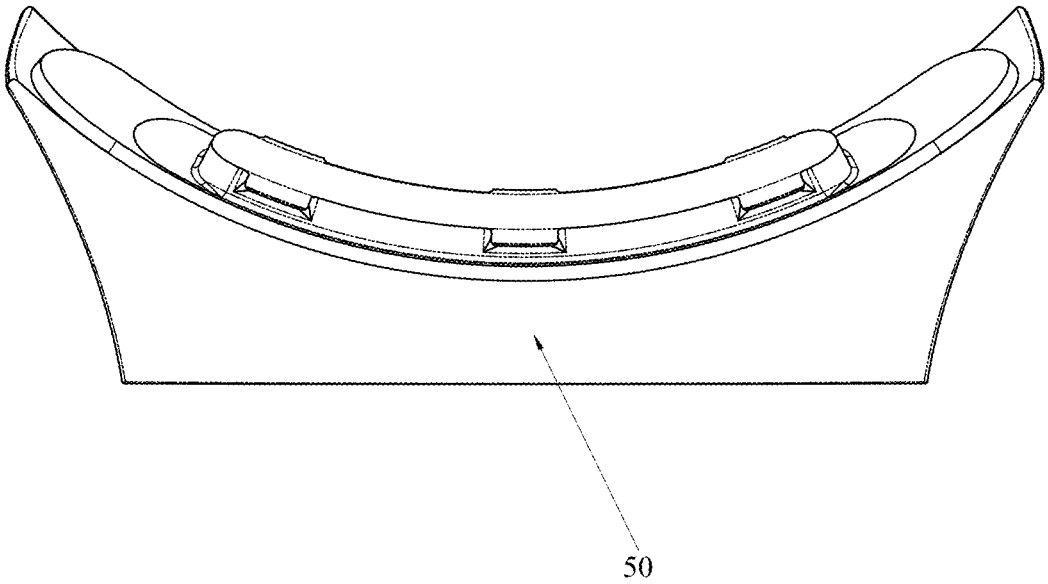
FIG. 28 is a schematic view of a fifth example of the strap connector according to an embodiment of the present invention.
Figure 29:
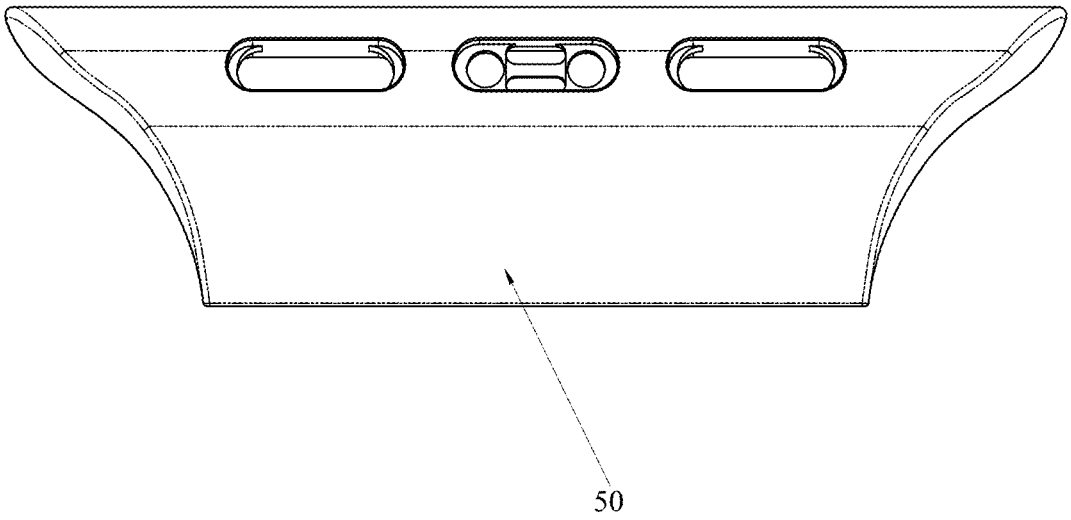
FIG. 29 is a schematic view of a sixth example of the strap connector according to an embodiment of the present invention.
Figure 30:
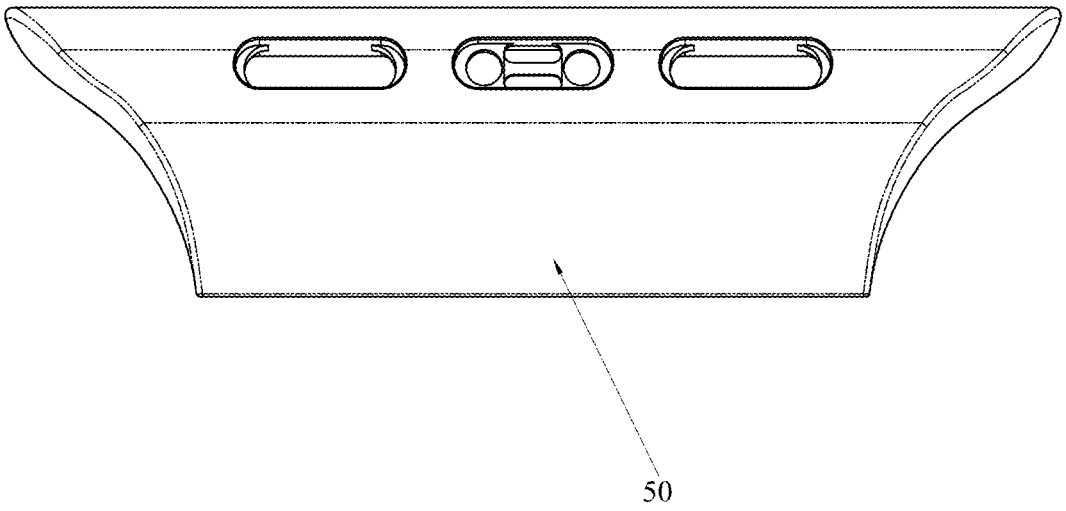
FIG. 30 is a schematic view of a seventh example of the strap connector according to an embodiment of the present invention.

FIG. 9 illustrates another structure of the strap connector. The strap connector includes a first housing 51, a first docking assembly 52, and a first control button 53 for controlling movement of the first docking assembly 52. The first housing 51 has a second chamber 54 for mounting the first docking assembly 52 and a third chamber 55 for mounting the first control button 53. The second chamber 54 communicates with the third chamber 55.

The first control button 53 extends out of the third chamber 55 and can be pressed backward and automatically returns forward when not pressed. The bottom end face of the first control button 53 has a first contact portion 531. A corresponding second contact portion 541 is provided in the second chamber 54. A second elastic member 56 is provided between the first contact portion 531 and the second contact portion 541. One end of the second elastic member 56 is connected to the first contact portion 531, and the other end of the second elastic member 56 is connected to the second contact portion 541.

A linking member 57 is connected to the rear side of the first control button 53. The linking member 57 has a slide chamber 571. The slide chamber 571 has a slide slope 572.

The first docking assembly 52 includes a first engaging member 521 and a first slide block 522. One end of the first engaging member 521 is connected to the first slide block 522. The first engaging member 521 slides along with the first slide block 522. The first slide block 522 is disposed on the slide slope 572 to slide along the slide slope 572. A first elastic member is provided on the first engaging member 521 for moving the first engaging member 521 to slide along the second chamber 54. When the first engaging member 521 is mounted in the second chamber 54, the other end of the first engaging member 521 can be extended out of the first housing 51 or retracted into the first housing 51.

Either end of the watch dial has an engaging hole for insertion of the first engaging member 521. One end of the first strap body 10 as well as the second strap body 20 is detachably connected to the watch dial through cooperation of the first engaging member 521 and the engaging hole. When the first control button 53 is pressed, the first control button 53 drives the first engaging member 521 to retract into the first housing 51 so that the first strap body 10 and the second strap body 20 can be detached from the watch dial. The disassembly and assembly process does not require the use of any tools, which brings convenience to the subsequent replacement or repair of the watch straps and watch dials. In particular, the structure is designed to be simple, easy and quick for disassembly and assembly, and is not prone to appear the situation of button jamming, so as to ensure the stability and reliability of the button when in use.

The other end of the first strap body 10 is connected to a coupling mechanism 11. The coupling mechanism 11 includes a coupling member 12 and a spring bar assembly 13. One end of the coupling member 12 is connected to the other end of the first strap body 10. Two sides of the coupling member 12 have mounting recesses 121. The spring bar assembly 13 is retractably disposed in the mounting recess 121. The spring bar assembly 13 includes a knob 14, a sleeve 15, and a first resilient device 16 between the knob 14 and the sleeve 15 for moving the knob 14 backward or forward.

Preferably, the other end of the coupling member 12 is connected to a forked plate. The forked plate includes a first plate 122 and a second plate 123. The first plate 122 and the second plate 123 each have a first end and a second end. The first end of the first plate 122 is connected to the other end of the coupling member 12. The second end of the first plate 122 is connected to the first end of the second plate 123. The second end of the second plate 123 is connected to the other end of a connecting member 22.

Figure 4:
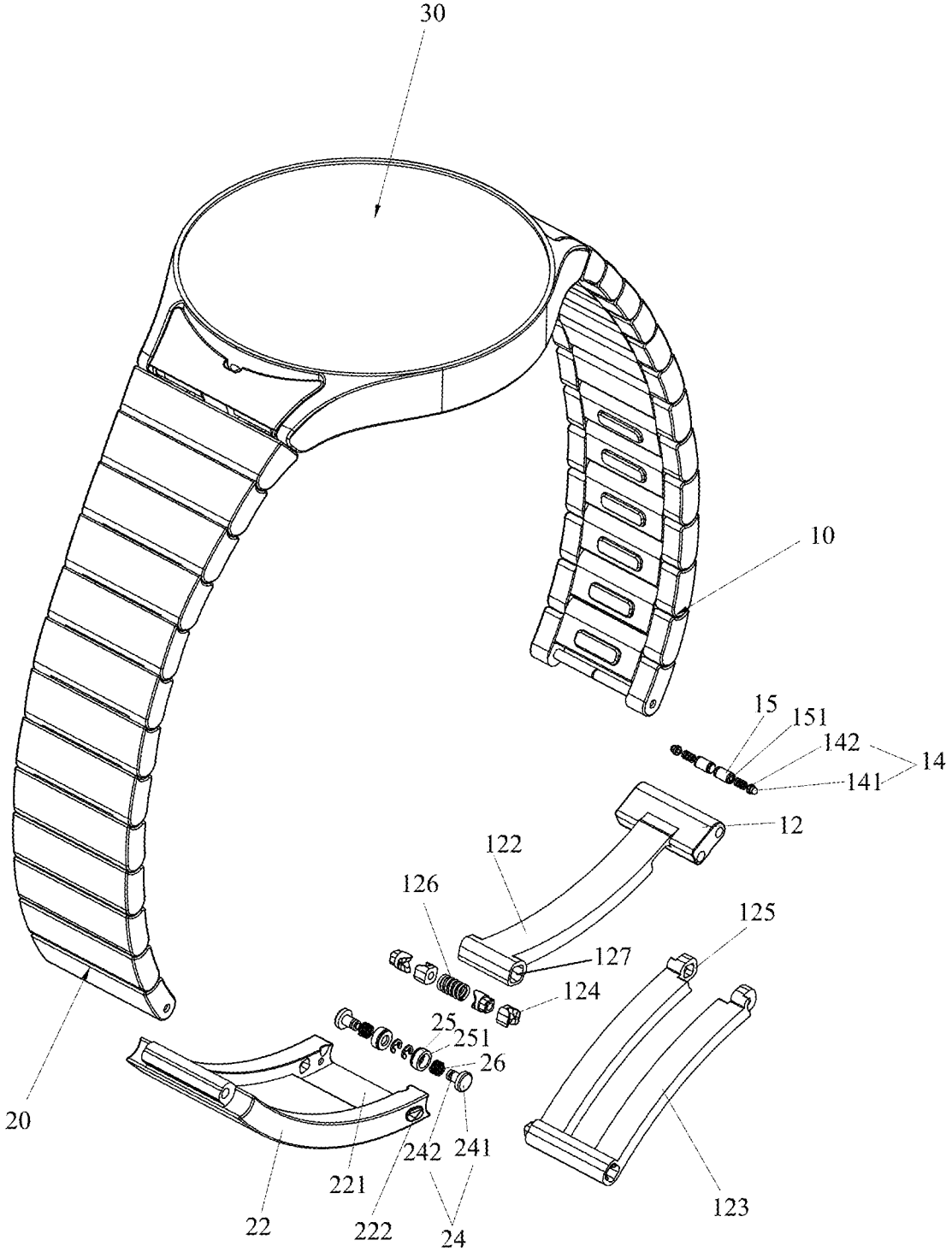
FIG. 4 is a first exploded view according to the first embodiment of the present invention.
Figure 5:
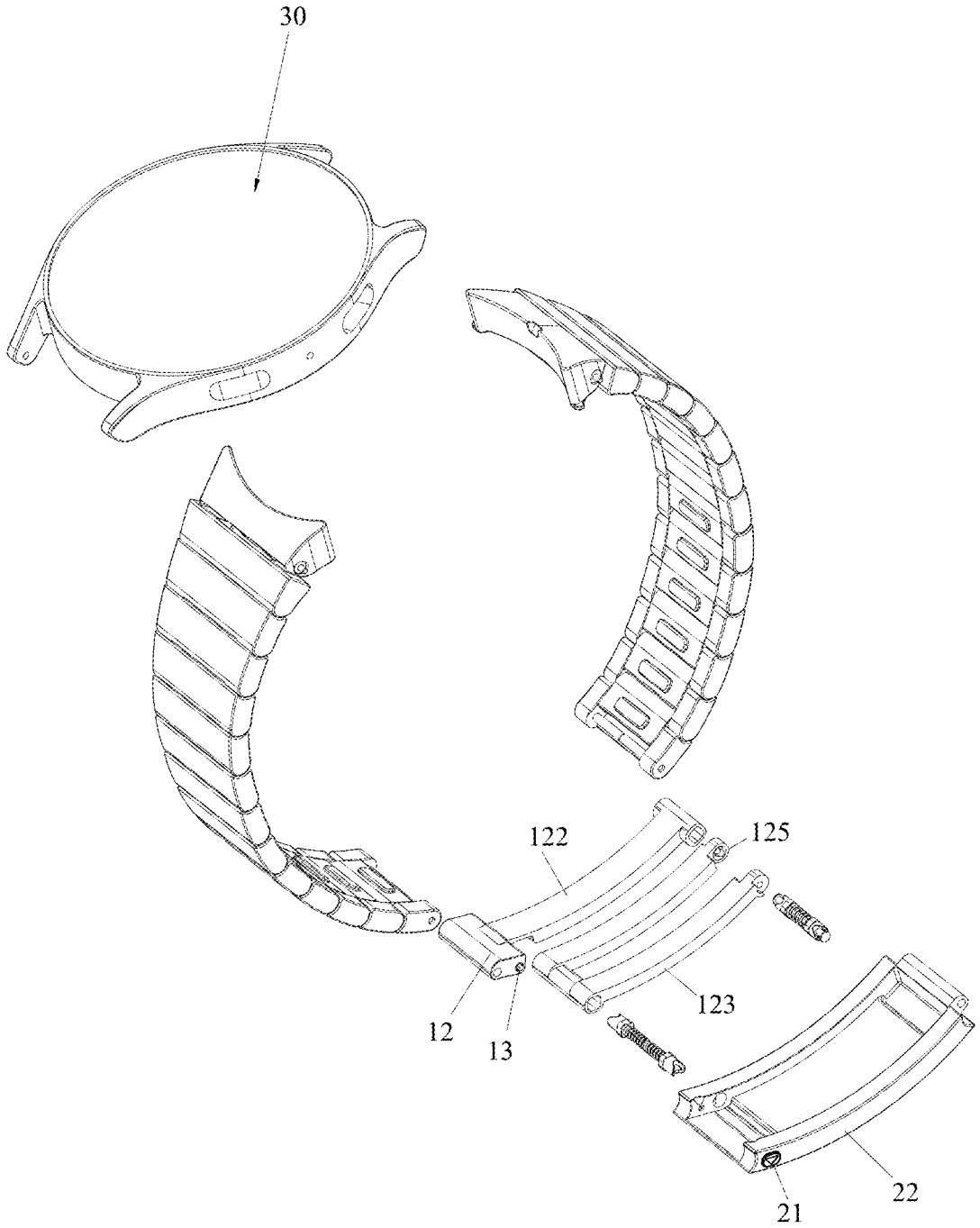
FIG. 5 is a second exploded view according to the first embodiment of the present invention.

The second end of the first plate 122 has a through chamber 127. Two rotating members 124 are provided in the through chamber 127. As shown in FIG. 4, the first end of the second plate 123 has pivot portions 125 corresponding to the two rotating members 124. The first plate 122 is selectively hinged to the second plate 123 through cooperation of the two rotating members 124 and the pivot portions 125. A third resilient device 126 is provided between the two rotating members 124. The two rotating members 124 each include a first rotating part and a second rotating part that are connected to each other. One end of the first rotating part extends out of the through chamber 127. Either end of the third resilient device 126 is against one end of the second rotating part. Under the action of the two rotating parts 124, the pivot portions 125 and the third resilient device 126, when the watch strap 40 is unfastened, the first plate 122 and the second plate 123 will be kept in the unfolded state. Under the action of the third resilient device 126, the first plate 122 and the second plate 123 are unfolded about 180 degrees, thereby preventing the first plate 122 and the second plate 123 from wobbling when the watch strap 40 is unfastened.

Preferably, the first rotating part includes a first connecting portion and a second connecting portion. The second rotating part includes a third connecting portion and a contact portion. Either end of the third resilient device 26 is against the contact portion. The first connecting portion is located in the pivot portion 125.

Figure 6:
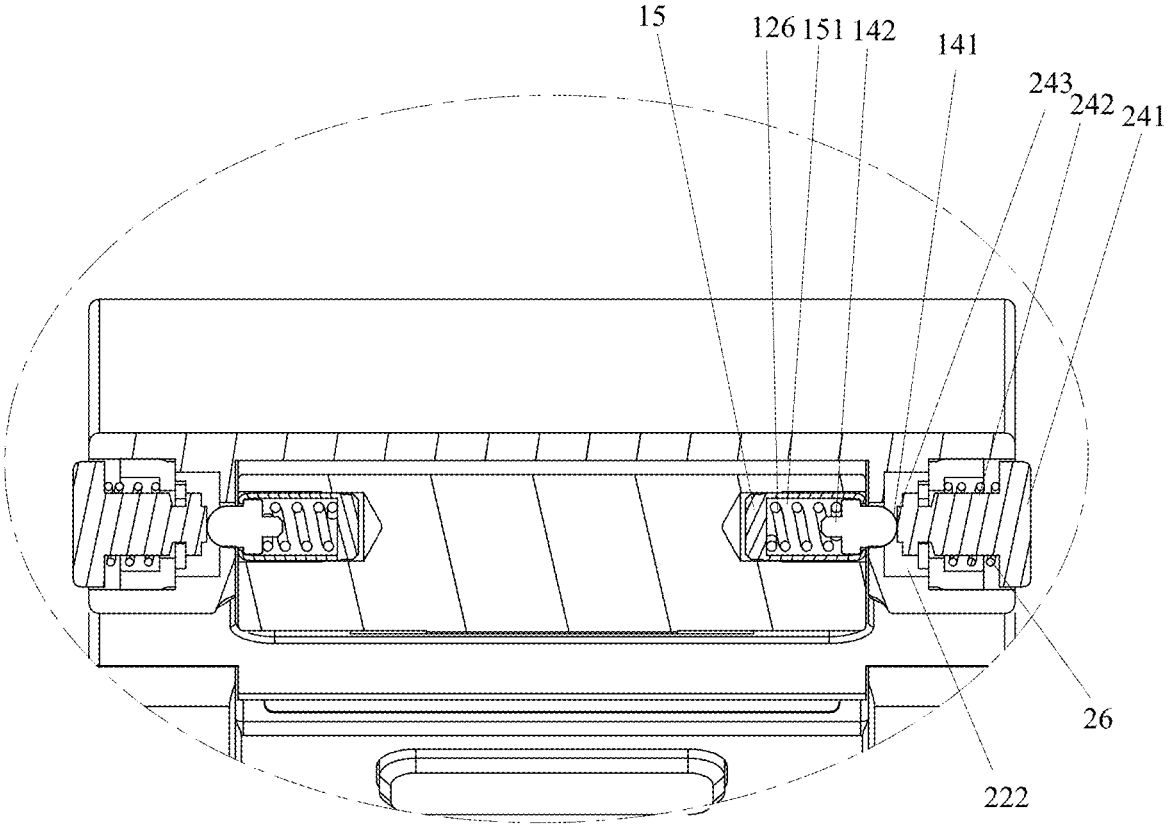
FIG. 6 is an enlarged view of circle A of FIG. 3.
Figure 7:
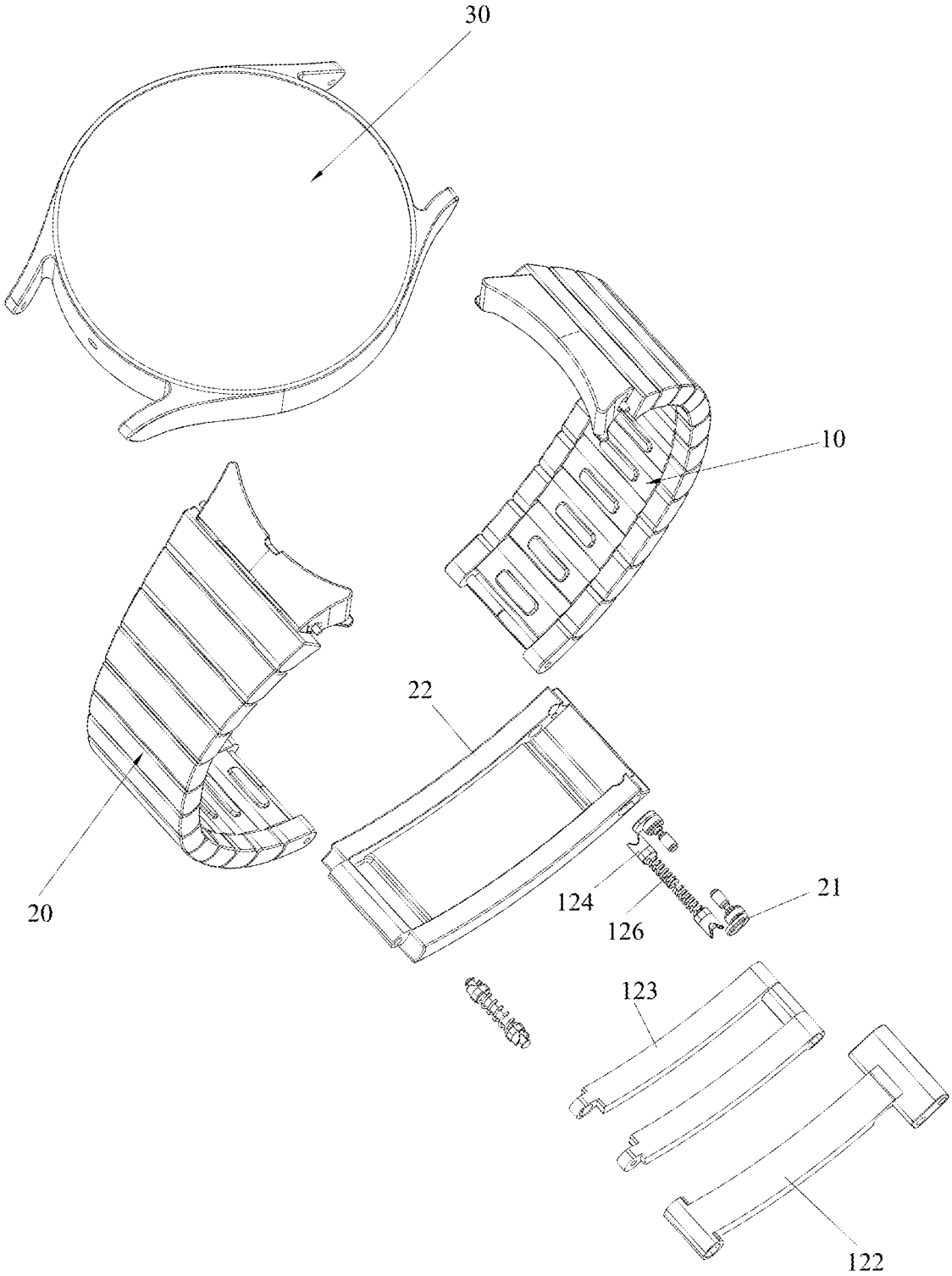
FIG. 7 is a third exploded view according to the first embodiment of the present invention.
Figure 8:
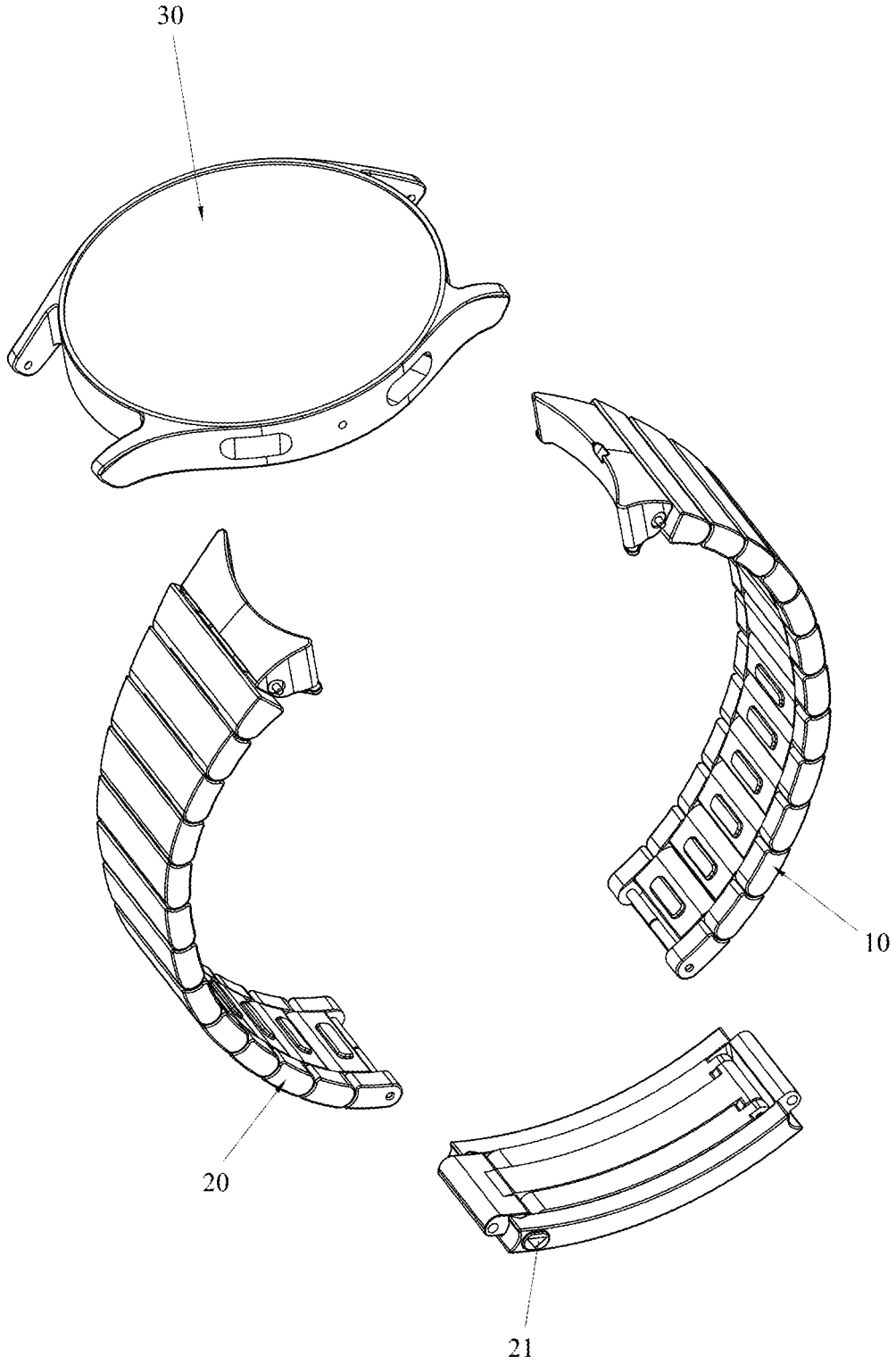
FIG. 8 is a fourth exploded view according to the first embodiment of the present invention.

As shown in FIG. 6, the two rotating members 124 may be connected by a rivet and are in fit with the pivot portions 125. After the watch strap 40 is unfastened, the first plate 122 and the second plate 123 will be kept in the unfolded state. Under the action of the third resilient device 126, the first plate 122 and the second plate 123 are unfolded about 180 degrees, thereby preventing the first plate 122 and the second plate 123 from wobbling when the watch strap 40 is unfastened. The first plate 122, the second plate 123 and the connecting member 22 are integrally formed by a mold. As shown in FIG. 7, the two rotating members 124 each may include only one rotating part on each side. The third resilient device 126 provides a holding force, so that the first plate 122 and the second plate 123 can be unfolded about 180 degrees, thereby preventing the first plate 122 and the second plate 123 from wobbling when the watch strap 40 is unfastened. A locking button 23 may be designed in different shapes, such as a circle, an ellipse, a triangle or other shapes, which can be selected according to actual needs and will not be described herein.

Preferably, the sleeve 15 has a first chamber 151 therein. The knob 14 includes a pressed portion 141 and a first hanging portion 142. The knob 14 is movably disposed in the first chamber 151. The pressed portion 141 extends out of the sleeve 15. One end of the first resilient device 16 is against the bottom end surface of the first chamber 151, and the other end of the first resilient device 16 is connected to the first hanging portion 142.

The other end of the second strap body 20 is connected to a button mechanism 21 configured for controlling extension and retraction of the spring bar assembly 13. The button mechanism 21 includes a connecting member 22 and a locking button 23. One end of the connecting member 22 is connected to the other end of the second strap body 20. The connecting member 22 has a first placement position 221 for mounting the coupling mechanism 11 and a second placement position 222 for mounting the locking button 23. The first placement position 221 communicates with the second placement position 222.

The locking button 23 includes a pressing member 24, a sleeving member 25 fitted on the pressing member 24, and a second resilient device 26 between the pressing member 24 and the sleeving member 25 for moving the pressing member 24 backward or forward. The locking button 23 is disposed in the second placement position 222. The button end of the pressing member 24 extends out of the connecting member 22.

The other end of the first strap body 10 is detachably connected to the other end of the second strap body 20 through cooperation of the coupling mechanism 11 and the connecting member 22, so that the locking button 23 and the spring bar assembly 13 are selectively moved closer to each other to be locked or moved away from each other to be unlocked.

Preferably, the sleeving member 25 has an accommodating chamber 251 therein. The accommodating chamber 251 runs through the sleeving member 25 and has an annular positioning surface 252 therein. The pressing member 24 includes a button portion 241, a second hanging portion 242 and a pressing portion 243 that are connected in sequence. The pressing member 24 is movably disposed in the accommodating chamber 251. The button portion 241 and the pressing portion 243 extend out of the sleeving member 25. The second resilient device 26 is sleeved on the second hanging portion 242. One end of the second resilient device 26 is against the annular positioning surface 252, and the other end of the second resilient device 26 is against one end face of the button portion 241.

The second strap body 20 has a strap loop 27. One end of the strap loop 27 is connected to the other end of the connecting member 22. The strap loop 27 has a slot 271.

The watch strap 40 shown in FIGS. 1 to 13 is a stainless steel strap. The watch strap 40 shown in FIGS. 14 to 17 is a leather strap. FIGS. 24 to 30 illustrate a variety of different models of strap connectors. In actual application, the strap connector is connected to one end of the leather strap, stainless steel strap or sports strap, so that the corresponding style and structure of the strap connector can be selected according to actual needs.

A watch comprises a watch dial 30 and a watch strap 40. The watch strap 40 is detachably connected to the watch dial 30. The watch strap 40 is the above-mentioned watch strap 40.

The exterior of one end of the watch dial is recessed inwardly to form a mounting groove 31. A docking groove 32 is disposed beside the mounting groove 31. The docking portion of the strap connector is connected to the docking groove 32. The end face of one side of the mounting groove 31 has a first locking portion 33 extending toward the mounting groove 31. The extension portion 59 of the strap connector extends into the mounting groove 31. The docking portion 591 is engaged with the docking groove 32. The first locking portion 33 and the second locking portion 592 are locked to each other. When the strap connector is connected to the watch dial, the docking portion and the docking groove form a predetermined position, so that the extension portion can be directly squeezed into the mounting groove to form an interlocking fit between the first locking portion and the second locking portion. This avoids inaccurate and time-consuming plugging problems and brings convenience to the assembly process.

The principles, key features, and advantages of present invention have been illustrated and described above. It shall be appreciated by people skilled in the art that the embodiments are not intended to limit the scope of the present invention. It is obvious that people skilled in the art might make various modifications and variations to the present invention without departing from the spirit and scope of the present invention. Provided that these modifications and variations of the present invention fall within the scope of the claims of the present invention, the present invention is intended to encompass all modifications and variations. Hence, the scope of the present invention shall only be defined by the appended claims and their equivalents.

What is claimed is:

1. A watch strap, comprising a first strap body and a second strap body, the first strap body and the second strap body each having two ends, one end of the first strap body and/or the second strap body being detachably connected to a first end of a strap connector; a second end of the strap connector being connected to a watch dial;

the other end of the first strap body being connected to a coupling mechanism, the coupling mechanism including a coupling member and a spring bar assembly; the coupling member having two ends, one end of the coupling member being connected to the other end of the first strap body, two sides of the coupling member having mounting recesses; the spring bar assembly being retractably disposed the mounting recesses, the spring bar assembly including a knob, a sleeve, and a first resilient device between the knob and the sleeve for moving the knob backward or forward;

the other end of the second strap body being connected to a button mechanism configured for controlling extension and retraction of the spring bar assembly; the button mechanism including a connecting member and a locking button; the connecting member having two ends, one end of the connecting member being connected to the other end of the second strap body; the connecting member having a first placement position for mounting the coupling mechanism and a second placement position for mounting the locking button, the first placement position communicating with the second placement position;

the locking button including a pressing member, a sleeving member fitted on the pressing member, and a second resilient device between the pressing member and the sleeving member for moving the pressing member backward or forward; the locking button being disposed in the second placement position, the pressing member having a button end extending out of the connecting member;

wherein the other end of the first strap body is detachably connected to the other end of the second strap body through cooperation of the coupling mechanism and the connecting member, so that the locking button and the spring bar assembly are selectively moved closer to each other to be locked or moved away from each other to be unlocked;

wherein the other end of the coupling member is connected to a forked plate, the forked plate includes a first plate and a second plate, the first plate and the second plate each have a first end and a second end, the first end of the first plate is connected to the other end of the coupling member, the second end of the first plate is connected to the first end of the second plate, and the second end of the second plate is connected to the other end of the connecting member; and wherein the second end of the first plate has a through chamber, two rotating members are provided in the through chamber; the first end of the second plate has pivot portions corresponding to the two rotating members, and the first plate is selectively hinged to the second plate through cooperation of the two rotating members and the pivot portions.

2. The watch strap of claim 1, wherein the sleeve has a first chamber therein, the knob includes a pressed portion and a first hanging portion, the knob is movably disposed in the first chamber, the pressed portion extends out of the sleeve; one end of the first resilient device is against a bottom end surface of the first chamber, and another end of the first resilient device is connected to the first hanging portion.

3. The watch strap of claim 1, wherein the sleeving member has an accommodating chamber therein, the accommodating chamber runs through the sleeving member and has an annular positioning surface therein; the pressing member includes a button portion, a second hanging portion and a pressing portion that are connected in sequence, the pressing member is movably disposed in the accommodating chamber, the button portion and the pressing portion extend out of the sleeving member, the second resilient device is sleeved on the second hanging portion, one end of the second resilient device is against the annular positioning surface, and another end of the second resilient device is against one end face of the button portion.

4. The watch strap of claim 1, wherein a third resilient device is provided between the two rotating members; the two rotating members each include a first rotating part and a second rotating part that are connected to each other, one end of the first rotating part extends out of the through chamber; and either end of the third resilient device is against one end of the second rotating part.

5. The watch strap of claim 1, wherein the first strap body and the second strap body each include a plurality of strap links, adjacent ones of the strap links are detachably connected to each other, and the first end of the strap connector is detachably connected to one end of the strap links.

6. The watch strap of claim 5, wherein the strap links each include a base, a second docking assembly on the base, and a second control button for controlling movement of the second docking assembly;

the second docking assembly includes a second engaging member, a second slide block, and a fitting member connected between the second engaging member and the second slide block, the second engaging member slides along with the second slide block;

the second control button extends out of the base and can be pressed backward and automatically returns forward when not pressed;

the first end of the strap connector has a mating groove corresponding to the second engaging member, the second docking assembly extends in the mating groove so that the second engaging member is engaged in the mating groove;

the second end of the strap connector has an extension portion and a docking portion corresponding to a docking groove of the watch dial; the docking portion is located beside the extension portion; and a second locking portion protrudes from the extension portion and corresponds to a first locking portion of the watch dial.

7. A watch, comprising a watch dial and a watch strap, the watch strap being detachably connected to the watch dial, the watch strap being the watch strap of claim 1; an exterior of one end of the watch dial being recessed inwardly to form a mounting groove, a docking groove being disposed beside the mounting groove, a docking portion of the strap connector being connected to the docking groove, the strap connector having a second locking portion; an end face of one side of the mounting groove having a first locking portion extending toward the mounting groove, the strap connector partially extending in the mounting groove, the docking portion being engaged with the docking groove, the first locking portion and the second locking portion being locked to each other.

* * * * *